US012416428B2

(12) United States Patent
Xing et al.

(10) Patent No.: US 12,416,428 B2
(45) Date of Patent: Sep. 16, 2025

(54) SEALING ASSEMBLY FOR WINDOW AIR CONDITIONER, AND WINDOW AIR CONDITIONER HAVING SAME

(71) Applicants: GD MIDEA AIR-CONDITIONING EQUIPMENT CO., LTD., Foshan (CN); MIDEA GROUP CO., LTD., Foshan (CN)

(72) Inventors: Zhigang Xing, Foshan (CN); Yu Liu, Foshan (CN); Hui Yu, Foshan (CN); Ali Zhao, Foshan (CN); Kangwen Zhang, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 489 days.

(21) Appl. No.: 17/779,489

(22) PCT Filed: Oct. 27, 2020

(86) PCT No.: PCT/CN2020/124109
§ 371 (c)(1),
(2) Date: May 24, 2022

(87) PCT Pub. No.: WO2021/103900
PCT Pub. Date: Jun. 3, 2021

(65) Prior Publication Data

US 2022/0412604 A1 Dec. 29, 2022

(30) Foreign Application Priority Data

Nov. 29, 2019 (CN) ..... 201911204609.X
Nov. 29, 2019 (CN) ..... 201922127449.5
(Continued)

(51) Int. Cl.
*F24F 13/20* (2006.01)
*F24F 1/031* (2019.01)
*F24F 13/22* (2006.01)

(52) U.S. Cl.
CPC ..... *F24F 13/20* (2013.01); *F24F 1/031* (2019.02); *F24F 13/224* (2013.01)

(58) Field of Classification Search
CPC ..... F24F 13/20; F24F 13/224; F24F 1/031; F24F 1/03; F24F 1/027
See application file for complete search history.

(56) References Cited

U.S. PATENT DOCUMENTS 4,248,057 A 2/1981 Yaguchi
5,979,533 A 11/1999 Dupuie
(Continued)

FOREIGN PATENT DOCUMENTS

CN 101749813 A 6/2010
CN 107345678 A 11/2017
(Continued)

OTHER PUBLICATIONS

Editors of the American Heritage Dictionaries (Ed.). (2016). Chamfer. In The American Heritage(R) Dictionary of the English Language (6th ed.). Houghton Mifflin. https://search.credoreference.com/articles/Qm9va0FydGljbGU6NDM5NjU0Mw==?aid=279753.*

(Continued)

*Primary Examiner* — Tavia Sullens
(74) *Attorney, Agent, or Firm* — Anova Law Group, PLLC

(57) ABSTRACT

A sealing assembly includes a fixation member and a sealing member connected to the fixation member. The fixation member is configured to be connected to a casing of a window air conditioner that is to be supported at a window
(Continued)

and has an accommodation groove. The sealing member is configured to be sealingly arranged between a window sash of the window and an inner wall of the window. The window sash is at least partially extended in the accommodation groove.

17 Claims, 35 Drawing Sheets

(30) Foreign Application Priority Data

| | | |
|---|---|---|
| Dec. 31, 2019 | (CN) | 201922495249.5 |
| Dec. 31, 2019 | (CN) | 201922496808.4 |
| Dec. 31, 2019 | (CN) | 201922500888.6 |

(56) References Cited

U.S. PATENT DOCUMENTS

| | | | | |
|---|---|---|---|---|
| 6,389,834 | B1 | 5/2002 | LeClear et al. | |
| 2011/0214443 | A1 | 9/2011 | Oka et al. | |
| 2017/0191679 | A1* | 7/2017 | Xu | F24F 13/32 |
| 2020/0248911 | A1 | 8/2020 | Lei et al. | |

FOREIGN PATENT DOCUMENTS

| | | | | | |
|---|---|---|---|---|---|
| CN | 206648184 | U | | 11/2017 | |
| CN | 107467876 | A | | 12/2017 | |
| CN | 108870565 | A | * | 11/2018 | F24F 1/027 |
| CN | 109724163 | A | | 5/2019 | |
| CN | 109724167 | A | * | 5/2019 | F24F 1/027 |
| CN | 109724168 | A | | 5/2019 | |
| CN | 109724169 | A | | 5/2019 | |
| CN | 109724170 | A | * | 5/2019 | F24F 1/027 |
| CN | 109724171 | A | | 5/2019 | |
| CN | 109724172 | A | | 5/2019 | |
| CN | 109724173 | A | | 5/2019 | |
| CN | 109974128 | A | | 7/2019 | |
| CN | 209558559 | U | | 10/2019 | |
| CN | 209588203 | U | | 11/2019 | |
| CN | 209689074 | U | | 11/2019 | |
| CN | 209689075 | U | | 11/2019 | |
| CN | 209763323 | U | | 12/2019 | |
| CN | 209763325 | U | | 12/2019 | |
| CN | 209763326 | U | | 12/2019 | |
| CN | 209763329 | U | | 12/2019 | |
| CN | 209763453 | U | | 12/2019 | |
| CN | 209857233 | U | | 12/2019 | |
| CN | 110736148 | A | | 1/2020 | |
| CN | 110822562 | A | | 2/2020 | |
| CN | 210118878 | U | | 2/2020 | |
| CN | 110906458 | A | | 3/2020 | |
| CN | 110906525 | A | | 3/2020 | |
| CN | 110966687 | A | | 4/2020 | |
| CN | 111043716 | A | | 4/2020 | |
| CN | 111059636 | A | | 4/2020 | |
| CN | 111059637 | A | | 4/2020 | |
| CN | 111059751 | A | | 4/2020 | |
| CN | 211119701 | U | | 7/2020 | |
| CN | 211261047 | U | | 8/2020 | |
| CN | 211261048 | U | | 8/2020 | |
| CN | 211261053 | U | | 8/2020 | |
| CN | 211261054 | U | | 8/2020 | |
| CN | 211261065 | U | | 8/2020 | |
| CN | 211261068 | U | | 8/2020 | |
| CN | 211261213 | U | | 8/2020 | |
| CN | 211261221 | U | | 8/2020 | |
| CN | 211261222 | U | | 8/2020 | |
| CN | 211345570 | U | | 8/2020 | |
| CN | 211345571 | U | | 8/2020 | |
| CN | 211345572 | U | | 8/2020 | |
| CN | 211345800 | U | | 8/2020 | |
| CN | 211345801 | U | | 8/2020 | |
| CN | 211400071 | U | | 9/2020 | |
| CN | 211400072 | U | | 9/2020 | |
| CN | 211400074 | U | | 9/2020 | |
| CN | 211400264 | U | | 9/2020 | |
| CN | 211476123 | U | | 9/2020 | |
| CN | 211476124 | U | | 9/2020 | |
| CN | 211476125 | U | | 9/2020 | |
| CN | 211575309 | U | | 9/2020 | |
| CN | 211650495 | U | | 10/2020 | |
| CN | 211650499 | U | | 10/2020 | |
| CN | 211650500 | U | | 10/2020 | |
| CN | 211650502 | U | | 10/2020 | |
| CN | 211650510 | U | | 10/2020 | |
| CN | 211650652 | U | | 10/2020 | |
| CN | 211716712 | U | | 10/2020 | |
| GB | 905271 | A | | 9/1962 | |
| IN | 211650518 | U | | 10/2020 | |
| KR | 20050116217 | A | | 12/2005 | |

OTHER PUBLICATIONS

Canadian Intellectual Property Office The Office Action For CA Application No. 3159470 Oct. 4, 2023 4 pages The World Intellectual Property Organization (WIPO) Written Opinion for PCT/CN2020/124109 Jan. 27, 2021 12 pages (including English translation).

The China National Intellectual Property Administration (CNIPA) The First Office Action for Chinese Application 201911204609.X Jun. 25, 2024 14 Pages (With Translation).

World Intellectual Property Organization (WIPO) International Search Report and Written Opinion for PCT/CN2020/124109 Jan. 27, 2021 14 Pages (with translation).

* cited by examiner

SEALING ASSEMBLY FOR WINDOW AIR CONDITIONER, AND WINDOW AIR CONDITIONER HAVING SAME

CROSS-REFERENCE TO RELATED APPLICATIONS

The present application is a National Stage Entry under 35 U.S.C. § 371 of International Application No. PCT/CN2020/124109, filed on Oct. 27, 2020, which is based on and claims priority to Chinese Patent Application No. 201922127449.5 filed on Nov. 29, 2019, Chinese Patent Application No. 201911204609.X filed on Nov. 29, 2019, Chinese Patent Application No. 201922500888.6 filed on Dec. 31, 2019, Chinese Patent Application No. 201922496808.4 filed on Dec. 31, 2019, and Chinese Patent Application No. 201922495249.5 filed on Dec. 31, 2019, the entire contents of all of which are incorporated herein by reference.

TECHNICAL FIELD

The present disclosure relates to the field of air conditioners, and more particularly, to a sealing assembly for a window air conditioner and a window air conditioner having same.

BACKGROUND

For a window air conditioner in the related art, a sealing assembly for the window air conditioner has poor sealing performance and a complex structure that is not easy to be mounted, which affect the applicable scope and performance of the window air conditioner.

SUMMARY

The present disclosure aims to solve at least one of the technical problems in the related art.

To this end, the present disclosure provides a sealing assembly for a window air conditioner to improve sealing performance of the sealing assembly.

The present disclosure also provides a window air conditioner having the above sealing assembly.

In the sealing assembly for the window air conditioner according to embodiments of the present disclosure, the window air conditioner is adapted to be supported at a window in a wall body and includes a casing having an accommodation groove. The window has a movable window sash provided therein, and the window sash is adapted to at least partially extend into the accommodation groove. The sealing assembly is adapted to be in contact with each of the window sash and an inner wall of the window. The sealing assembly includes a fixation member connected to the casing, and a sealing member connected to the fixation member and adapted to be sealingly arranged between the window sash and the inner wall of the window.

With the sealing assembly for the window air conditioner according to the embodiments of the present disclosure, by sealingly arranging the sealing member between the window sash and the inner wall of the window, on the one hand, the sealing assembly has improved sealing performance, and on the other hand, the sealing assembly has a good sound insulation effect. In addition, the sealing member can be cut based on a distance between a side wall surface of the casing and an inner wall surface of the window, such that the sealing member can be mounted more conveniently, which in turn simplifies a structure of the sealing assembly.

In some embodiments of the present disclosure, the fixation member has a mounting groove formed therein. Further, a part of the sealing member is mounted in the mounting groove.

In some embodiments of the present disclosure, the mounting groove has a locking ridge provided on each of opposite side surfaces thereof. Further, the locking ridge is configured to be in contact with the sealing member to position the sealing member within the mounting groove.

In some embodiments of the present disclosure, the window air conditioner further includes a rotation support fixed at the casing. The fixation member is rotatably disposed on the rotation support in such a manner that the sealing assembly is capable of being rotated to be received in the accommodation groove.

In some embodiments of the present disclosure, the rotation support has a rib provided on each of opposite side walls thereof. Further, the rib is configured to be in contact with an inner wall surface of the accommodation groove at a corresponding side.

In some embodiments of the present disclosure, the rib has a guide chamfer provided at a lower end thereof.

In some embodiments of the present disclosure, the rotation support has a sealing plate provided on each of the opposite side walls thereof. Further, the sealing plate extends towards the inner wall surface of the accommodation groove at the corresponding side and is located above the rib on the corresponding side.

In some embodiments of the present disclosure, the sealing assembly further includes an angle positioning assembly configured to cooperate with each of the rotation support and the fixation member to position the fixation member at a predetermined angle when the fixation member is rotated to the predetermined angle.

In a window air conditioner according to embodiments of the present disclosure, the window air conditioner is adapted to be supported at a window in a wall body. The window has a movable window sash provided therein. The window air conditioner includes: a casing having an accommodation groove formed therein, the window sash being adapted to at least partially extend into the accommodation groove; and the sealing assembly according to the embodiments as described above, the sealing assembly being adapted to be sealingly arranged between the window sash and the inner wall of the window.

In the window air conditioner according to the embodiments of the present disclosure, by sealingly arranging the sealing member between the window sash and the inner wall of the window, on the one hand, the sealing assembly has improved sealing performance, and on the other hand, the sealing assembly has a good sound insulation effect. In addition, a sealing member of the sealing assembly can be cut based on a distance between a side wall surface of the casing and an inner wall surface of the window, such that the sealing member can be mounted more conveniently, which in turn simplifies a structure of the sealing assembly.

In some embodiments of the present disclosure, the window air conditioner further includes a positioning device having an unlocked state in which the positioning device is separated from the window sash and a locked state in which the positioning device is brought into contact with the window sash to position the window sash.

In some embodiments of the present disclosure, the casing includes a base, a rear housing fixed at the base and configured to accommodate an outdoor heat exchanger, a front housing fixed at the base and arranged to be spaced apart from the rear housing to form the accommodation groove, and a middle partition plate fixed at the base and located within the accommodation groove. Further, the middle partition plate is configured to be engaged with the rear housing and the front housing at a front end and a rear end thereof, respectively.

In some embodiments of the present disclosure, the middle partition plate has a placement space provided thereon. Further, the placement space is opened at a top thereof, and the rotation support is received within the placement space. The fixation member has an accommodation space formed therein. An outer edge of the placement space extends, in response to the sealing assembly being rotated out of the accommodation groove, into the accommodation space in such a manner that the sealing assembly is substantially flush with the middle partition plate.

In some embodiments of the present disclosure, the middle partition plate has a drainage hole formed therein. Further, the drainage hole is adapted to drain water in the middle partition plate to an outdoor side.

In some embodiments of the present disclosure, the middle partition plate includes a bottom plate and side plates formed at opposite sides of the bottom plate. A receiving groove is formed between the side plates and the bottom plate, and the drainage hole is arranged at a bottom portion of the receiving groove.

In some embodiments of the present disclosure, the receiving groove of the middle partition plate has a plurality of drainage holes formed therein. Further, at least part of the plurality of drainage holes is adapted to drain water to a part of the base corresponding to the outdoor side. The window air conditioner further includes a water receiving tray mounted on the base. Further, a part of the plurality of drainage holes is adapted to drain water to the water receiving tray to be discharged to an outdoor part of the base through the water receiving tray.

In some embodiments of the present disclosure, the receiving groove is recessed downwardly at each of both ends thereof to form a placement space. The plurality of drainage holes includes a first drainage hole formed at one end of the placement space. Further, the first drainage hole is adapted to drain water to the water receiving tray. The water receiving tray has a drainage groove configured to drain water to the base. The first drainage hole is correspondingly located above the drainage groove. And/or, the plurality of drainage holes include a second drainage hole formed at the other end of the placement space. The second drainage hole is adapted to drain water to the base.

In some embodiments of the present disclosure, the receiving groove is recessed downwardly in a middle portion thereof to form a recess. The plurality of drainage holes further include a third drainage hole formed at a bottom portion of the recess. Further, the third drainage hole is adapted to drain water to the part of the base corresponding to the outdoor side.

In some embodiments of the present disclosure, the recess has a fixation hole passing through a bottom portion thereof. Further, the fixation hole is adapted to be connected and fixed to the water receiving tray by a connection member, and the third drainage hole is located on a periphery of the fixation hole.

In some embodiments of the present disclosure, the water receiving tray partially extends to a position below the middle partition plate and has a support member formed at a part thereof located below the middle partition plate. Further, the support member is adapted to support the middle partition plate.

In some embodiments of the present disclosure, the side plate close to the rear housing has a water overflowing hole formed therein. Further, the water overflowing hole passes through the side plate and is adapted to drain water to the part of the base corresponding to the outdoor side.

In some embodiments of the present disclosure, the base has a support member provided thereon. Further, the support member corresponds to the accommodation groove, and the middle partition plate is mounted on the support member and adapted to abut with the window sash. The middle partition plate has a positioning member provided on a bottom surface thereof, and the support member is formed with a socket corresponding to the positioning member. Further, the middle partition plate is inserted in and connected to the socket of the support member with the positioning member.

In some embodiments of the present disclosure, the window air conditioner further includes a water receiving tray mounted on the base. Further, the water receiving tray corresponds to the front housing, and the support member is formed on the water receiving tray to be arranged on the base by the water receiving tray, or the support member is formed on the base.

In some embodiments of the present disclosure, a plurality of positioning members are provided. Further, the plurality of positioning members being arranged at intervals in a length direction of the middle partition plate and includes a first positioning member and a second positioning member which are different from each other in shape. A plurality of sockets are provided correspondingly. Further, the plurality of sockets are inserted in and connected to the plurality of positioning members with the plurality of positioning members respectively, and includes a first socket for an insertion of the first positioning member and a second socket for an insertion of the second positioning member.

In some embodiments of the present disclosure, the middle partition plate includes a bottom plate and end side plates formed at both ends of the bottom plate. Further, the bottom plate has the positioning member formed on a bottom surface thereof to be inserted in and connected to the socket of the support member. The end side plates are connected to opposite side walls of the base, respectively.

In some embodiments of the present disclosure, one of the side wall of the base and the end side plate has a laterally protruding snap buckle provided thereon, and the other of the side wall of the base and the end side plate has an engagement hole formed therein. Further, the engagement hole corresponds to the snap buckle and is adapted to be engaged with the snap buckle.

In some embodiments of the present disclosure, each of the end side plates includes a first plate body connected to the bottom plate and a second plate body connected to the first plate body. Further, the second plate body is formed with the snap buckle, and the second plate body and the first plate body being connected to each other at a connection platform configured to abut with an upper edge of the side wall of the base.

In some embodiments of the present disclosure, the middle partition plate further includes side plates formed at opposite sides of the bottom plate. Further, one of the side plates has a support platform formed on an inner surface thereof, and the support platform extends in a length direction of the side plate. The front housing has a notch formed at a back plate thereof. Further, the notch corresponds to the support platform and abuts with the support platform at an upper edge thereof.

In some embodiments of the present disclosure, the middle partition plate further has a fixation part formed at a middle portion thereof. The support member has an engagement member formed thereon. Further, the engagement member corresponds to the fixation part, and the fixation part is connected and fixed to the engagement member by a connection member.

In some embodiments of the present disclosure, the casing has a fixation plate extending therefrom towards the fixation part. The connection member passes through the fixation plate, the fixation part and the engagement member in sequence to integrally connect and fix the middle partition plate to the casing and the support member.

Additional aspects and advantages of the present disclosure will be given at least in part in the following description, or become apparent at least in part from the following description, or can be learned from practicing of the present disclosure.

BRIEF DESCRIPTION OF DRAWINGS

The above and/or additional aspects and advantages of the present disclosure will become more apparent and more understandable from the following description of embodiments taken in conjunction with the accompanying drawings, in which.

DESCRIPTION OF EMBODIMENTS

Figure 1:
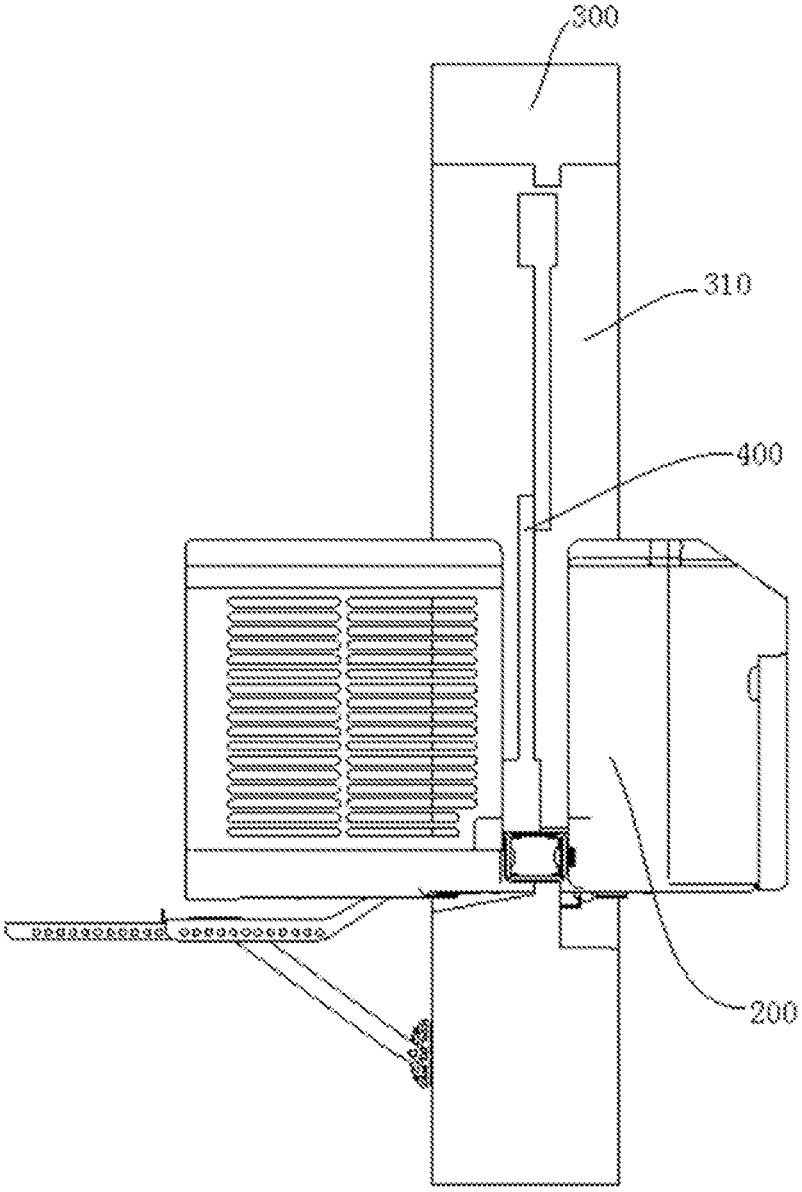
FIG. 1 is a side view of a window air conditioner according to an embodiment of the present disclosure.
Figure 2:
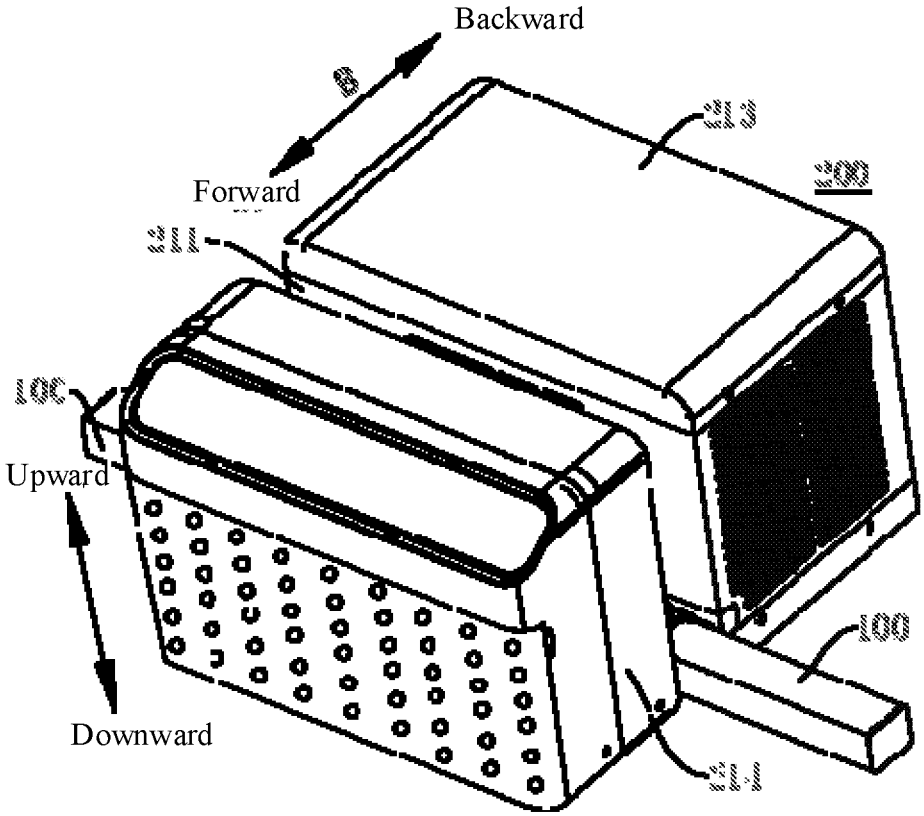
FIG. 2 is a schematic structural perspective view of the window air conditioner illustrated in FIG. 1.
Figure 3:
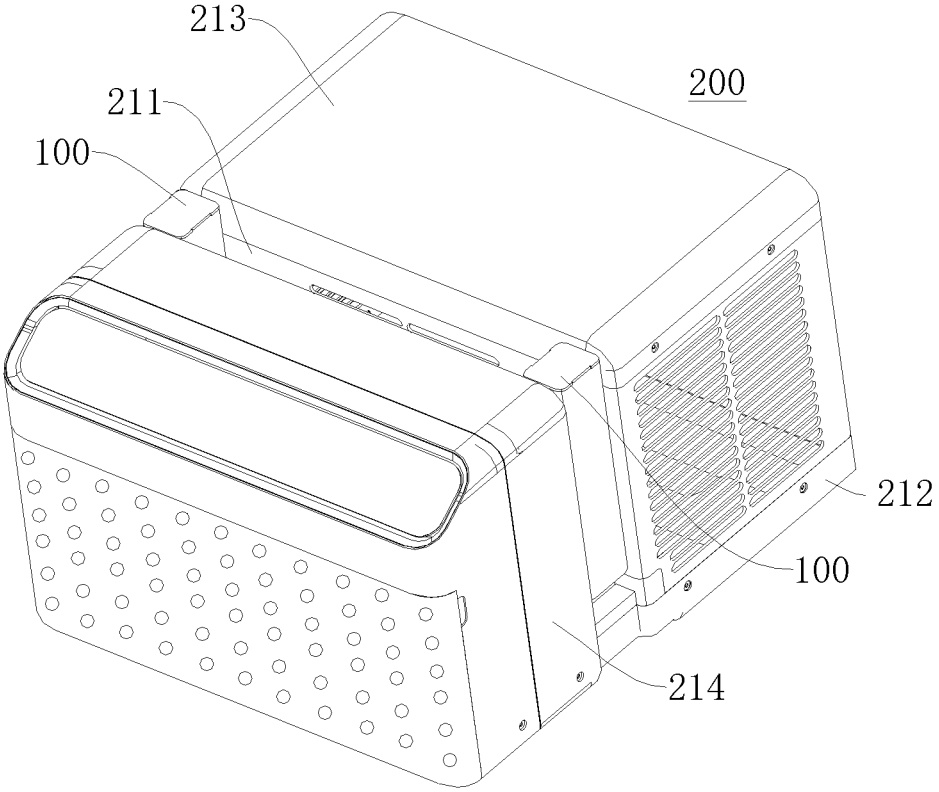
FIG. 3 is a schematic structural perspective view of the window air conditioner in a state in which a sealing assembly illustrated in FIG. 2 is received in an accommodation groove.
Figure 4:
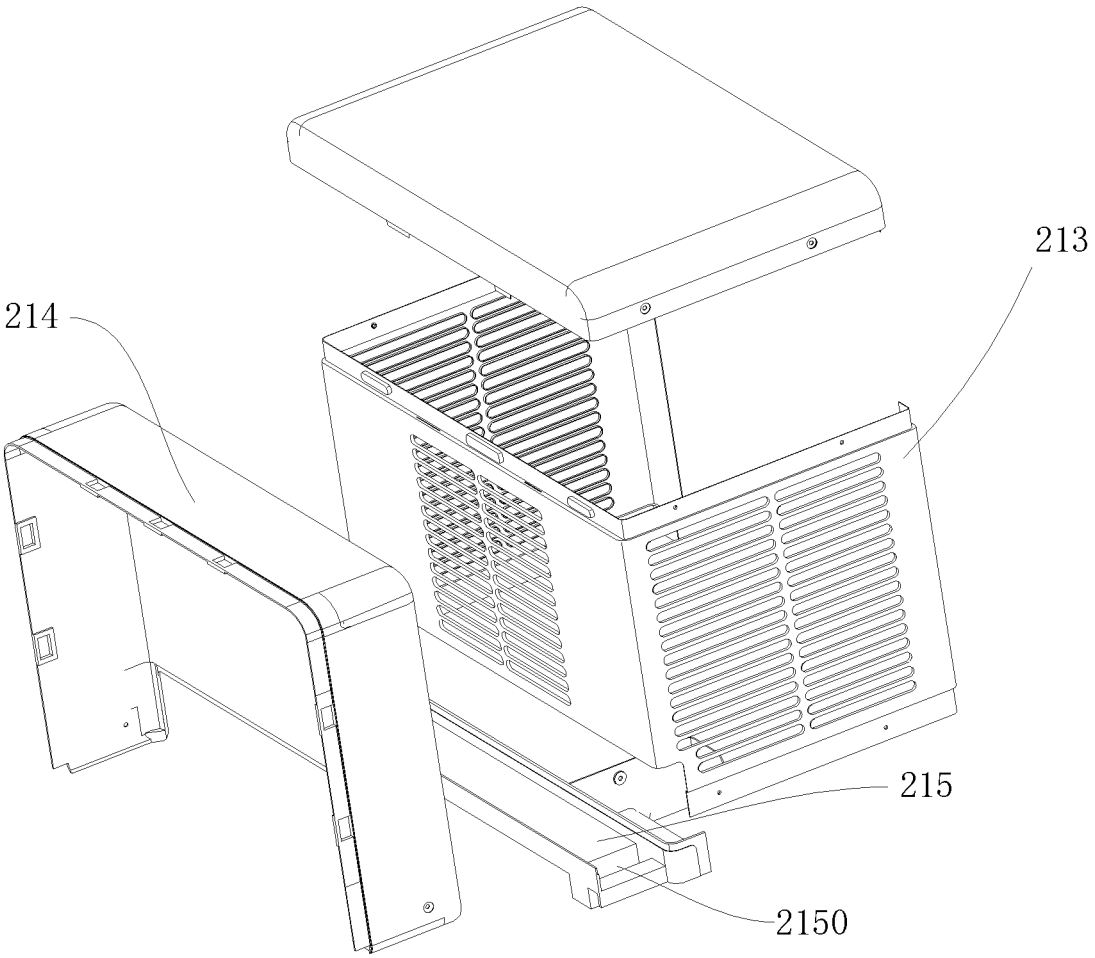
FIG. 4 is an exploded view of the window air conditioner illustrated in FIG. 1.
Figure 5:
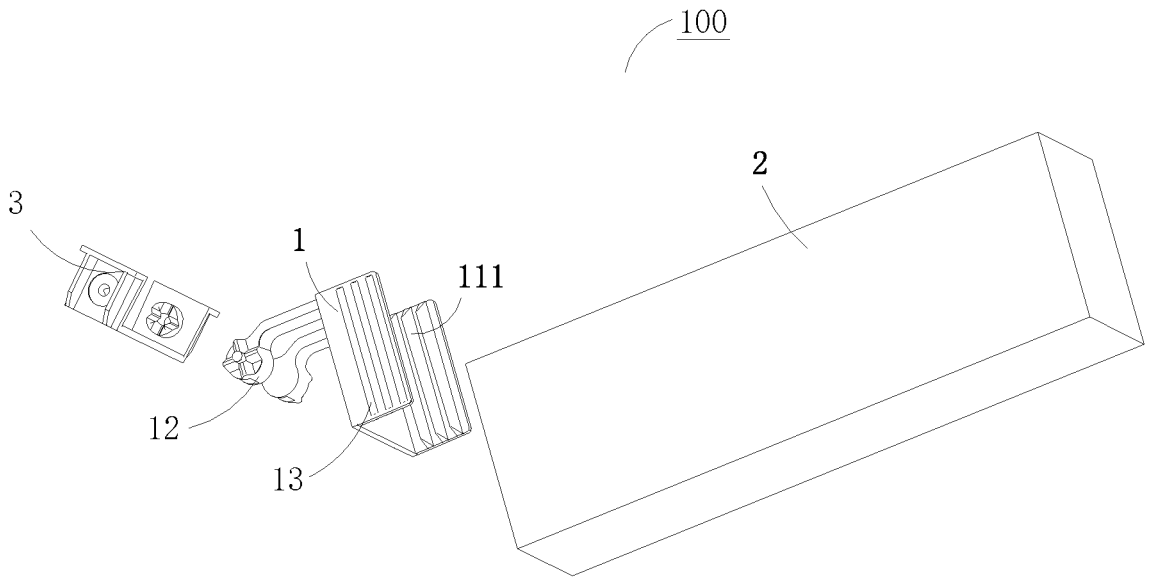
FIG. 5 is an exploded view of a sealing assembly according to an embodiment of the present disclosure.
Figure 6:
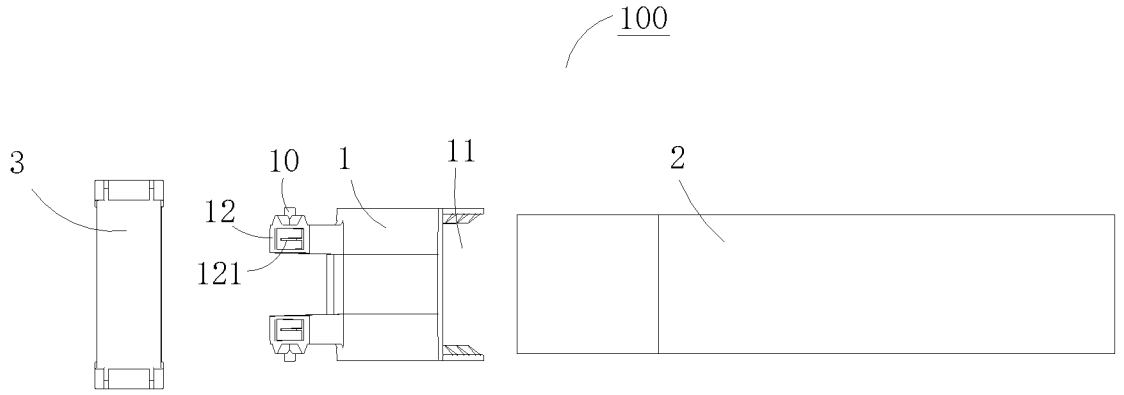
FIG. 6 is a top view of the sealing assembly illustrated in FIG. 5.
Figure 7:
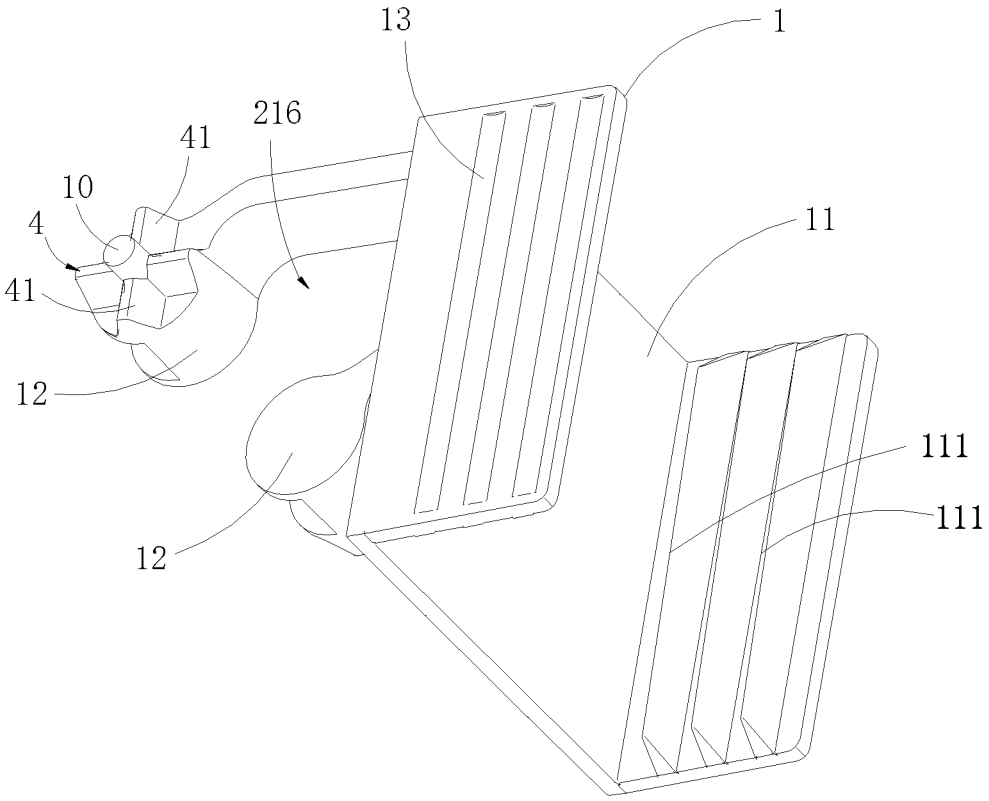
FIG. 7 is a schematic structural perspective view of a fixation member illustrated in FIG. 5.
Figure 8:
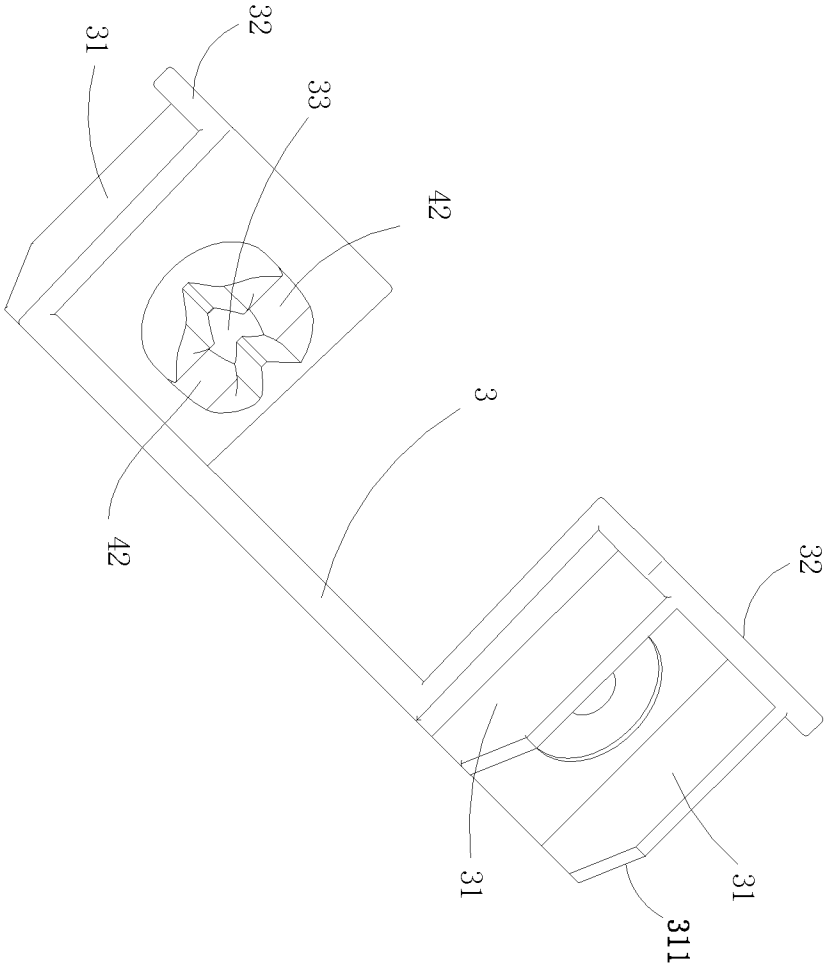
FIG. 8 is a schematic structural perspective view of a rotation support illustrated in FIG. 5.

Embodiments of the present disclosure are described below in detail, examples of the embodiments are shown in accompanying drawings, and throughout the description, the same or similar reference signs represent the same or similar components or the components having the same or similar functions. The embodiments described below with reference to the accompanying drawings are exemplary and merely used to explain the present disclosure, rather than being construed as limitation on the present disclosure.

In the description of the present disclosure, it should be understood that the orientation or position relationship indicated by the terms "center," "longitudinal," "transverse," "length," "width," "thickness," "upper," "lower," "front," "rear," "left," "right," "vertical," "horizontal," "top," "bottom," "inner," "outer," "clockwise," "counterclockwise," "axial," "radial," "circumferential" etc., is based on the orientation or position relationship shown in the drawings, and is only for the convenience of describing the present disclosure and simplifying the description, rather than indicating or implying that the associated device or element must have a specific orientation or must be constructed and operated in a specific orientation. Thus, the orientation or position relationship indicated by these terms cannot be understood as limitations on the present disclosure. In addition, the features associated with terms "first" and "second" may explicitly or implicitly include at least one of the features. In the description of the present disclosure, "plurality" means at least two, unless otherwise specifically defined.

In the description of the present disclosure, it should be noted that, unless otherwise clearly specified and defined, terms such as "install," "mount," "connect to," "connected with" should be understood in a broad sense. For example, it may be a fixed connection or a detachable connection or integral connection; it may be a mechanical connection or an electrical connection; it may be a direct connection or an indirect connection by an intermediate; it may be an internal communication of two components. For those of ordinary skill in the art, the specific meaning of the above-mentioned terms in the present disclosure can be understood according to specific circumstances.

A sealing assembly 100 for a window air conditioner 200 according to an embodiment of the present disclosure will be described below with reference to FIG. 1 to FIG. 9. The window air conditioner 200 is adapted to be supported at a window 310 in a wall body 300. The window 310 has a movable window fan 400 provided therein. The window fan 400 is movably arranged within the window 310 in an up and down direction to open or close the window 310.

The window air conditioner 200 includes a casing 210 having an accommodation groove 211, and the window fan 400 is adapted to at least partially extend into the accommodation groove 211. It should be understood that the casing 210 is divided into an indoor part and an outdoor part by the accommodation groove 211, and the window fan 400 is at least partially extendable into the accommodation groove 211. The indoor part has an indoor heat exchanger and an indoor fan that are provided therein, and the outdoor part has an outdoor heat exchanger and an outdoor fan that are provided therein.

Further, the accommodation groove 211 is recessed downwards from a top wall of the casing 210. Thus, the window air conditioner 200 may not only be exerted with force more uniformly to avoid a damage to the top wall of the window air conditioner 200 due to a great force, thereby improving installation reliability and operation performance of the window air conditioner 200, but also an air outlet of the window air conditioner 200 may be arranged at a high position to facilitate flowing of an outlet airflow in an indoor space, thereby facilitating an increase in temperature regulation efficiency of the window air conditioner 200 and an improvement of a regulation effect on an indoor temperature of the window air conditioner 200.

In the sealing assembly 100 for the window air conditioner 200 according to the embodiments of the present disclosure, the sealing assembly 100 is adapted to be in contact with each of the window fan 400 and an inner wall of the window 310. It should be understood that in a state where the window sash 400 closes the window, the sealing assembly 100 can be brought into contact with the window sash 400 at one side thereof and with the inner wall of the window 310 at the other side thereof, thereby improving the sealing performance of the sealing assembly 100.

Specifically, the sealing assembly 100 includes a fixation member 1 and a sealing member 2. The fixation member 1 is connected to the casing 210. The sealing member 2 is connected to the fixation member 1 and adapted to be sealingly arranged between the window sash 400 and the inner wall of the window 310. The sealing member 2 may be made of an elastic substance such as a sponge or rubber. It should be understood that the sealing member 2 is connected to the casing 210 by the fixation member 1. In the state where the window sash 400 closes the window, the sealing member 2 is brought into contact with the window sash 400 at one side thereof and with the inner wall of the window 310 at the other side thereof, and the window is therefore sealed by the sealing member 2. In this manner, on the one hand, the sealing assembly 100 can have improved sealing performance, and on the other hand, the sealing assembly 100 can have a good sound insulation effect.

Further, the sealing member 2 may have an adjustable length which can be cut on site based on a distance between a side wall surface of the casing 210 and an inner wall surface of the window 310, such that the sealing member 2 can provide better sealing to the window, thereby ensuring sealing of the window while the sealing assembly 100 has a simpler structure.

In the sealing assembly 100 for the window air conditioner 200 according to the embodiments of the present disclosure, by sealingly arranging the sealing member 2 between the window sash 400 and the inner wall of the window 310, on the one hand, the sealing assembly 100 has improved sealing performance, and on the other hand, the sealing assembly 100 has a good sound insulation effect. In addition, the sealing member 2 can be cut based on the distance between the side wall surface of the casing 210 and the inner wall surface of the window 310, such that the sealing member 2 can be mounted more conveniently, which in turn simplifies a structure of the sealing assembly 100.

As illustrated in FIG. 5 to FIG. 8, in some embodiments of the present disclosure, the fixation member 1 has a mounting groove 11 formed therein, and a part of the sealing member 2 is mounted within the mounting groove 11. That is, by fixing the part of the sealing member 2 in the mounting groove 11, a connection structure between the sealing member 2 and the fixation member 1 is simpler and more reliable, which in turn allows sealing member 2 to be connected to the casing 210 easily, and the sealing assembly 100 thus has a simpler structure.

In some embodiments of the present disclosure, the sealing member 2 may be a sealing sponge. For example, the sealing member 2 may be made of a polyvinyl alcohol (PVA) material, so that the sealing assembly 100 has unique strong bonding, film flexibility, smoothness, oil resistance, solvent resistance, protective colloid property, gas barrier property, wear resistance, and water resistance after a special treatment. Therefore, entry of the water into the indoor space is avoided, thereby improving the water resistance of the sealing assembly 100.

As illustrated in FIG. 5 to FIG. 8, in some embodiments of the present disclosure, the mounting groove 11 has a locking ridge 111 provided on each of opposite side surfaces thereof, and the locking ridge 111 is configured to be in contact with the sealing member 2 to position the sealing member 2 within the mounting groove 11. That is, by arranging the locking ridge 111 on each of the opposite side surfaces of the mounting groove 11, the locking ridge 111 is brought into contact with the sealing member 2 in the mounting groove 11 to lock the sealing member 2 into the mounting groove 11, thereby improving a strength of a connection between the sealing member 2 and the fixation member 1. In this manner, the connection between the sealing member 2 and the fixation member 1 is more stable and reliable.

In some embodiments of the present disclosure, the locking ridge 111 extends obliquely relative to a side wall of the mounting groove 11. That is, the locking ridge 111 arranged obliquely can lock the sealing member 2 into the mounting groove 11 more stably, thereby improving stability of the sealing member 2.

In some embodiments of the present disclosure, an included angle between the locking ridge 111 and a corresponding one of the side surfaces of the mounting groove 11 is in a range from 30° to 90°. In this manner, the locking ridge 111 is capable of tightly locking the sealing member 2 into the mounting groove 11 to implement a more secure connection between the sealing member 2 and the fixation member 1.

In some embodiments of the present disclosure, the fixation member 1 has a first groove 13 formed at an outer side surface thereof. It should be understood that the first groove 13 is arranged on the outer side surface of the fixation member 1 to facilitate a mould opening of the fixation member 1 in such a manner that uniformity of a wall thickness of the fixation member 1 can be ensured to allow a molten adhesive material to flow easily, and therefore, to facilitate fabrication and processing of the fixation member 1. In addition, it is convenient that the first groove 13 can increase a friction when assembling and disassembling the fixation member 1, which in turn facilitates the assembly and disassembly of the fixation member 1.

As illustrated in FIG. 5 to FIG. 8, in some embodiments of the present disclosure, the mounting groove 11 has a plurality of locking ridges 111 provided on each side wall of the opposite side surfaces thereof. That is, the mounting groove 11 has two side surfaces that are arranged opposite to each other, each of which is provided with the plurality of locking ridges 111. Each of the plurality of locking ridges 111 is in contact with the sealing member 2 to better lock the sealing member 2 in the mounting groove 11, thereby further making the connection between the sealing member 2 and the fixation member 1 more stable and reliable. In some embodiments of the present disclosure, the mounting groove 11 has three spaced-apart locking ridges 111 provided on each side surface thereof, thereby ensuring the strength of the connection between the sealing member 2 and the fixation member 1.

Specifically, each locking ridge 111 is formed by a portion of the fixation member 1 projecting towards an inside of the mounting groove 11, thereby providing a simple structure for the fixation member 1.

As illustrated in FIG. 5 to FIG. 8, in some embodiments of the present disclosure, the sealing assembly 100 further includes a rotation support 3 fixed at the casing 210. The fixation member 1 is rotatably arranged on the rotation support 3 in such a manner that the sealing assembly 100 is capable of being rotated to be received in the accommodation groove 211. In this way, it is possible to not only facilitate mounting and arrangement of the fixation member 1, but also facilitate a rotation of the fixation member 1 relative to the rotation support 3, such that the sealing assembly 100 is easily stored to reduce a space occupied by the sealing assembly 100.

Further, the fixation member 1 has a pivoting shaft 10 provided thereon, the rotation support 3 has a pivoting hole 33 formed therein, and the pivoting shaft 10 and the pivoting hole 33 are configured to be rotatably engaged with each other. In this manner, the pivoting shaft 10 and the pivoting hole 33 can be engaged with each other to facilitate a smooth rotation of the fixation member 1 and an improvement of the reliability of the rotation of the fixation member 1.

As illustrated in FIG. 5 to FIG. 8, in some embodiments of the present disclosure, the rotation support 3 has a rib 31 provided on each of opposite side walls thereof, and the rib 31 is configured to be in contact with an inner wall surface of the accommodation groove 211 at a corresponding side thereof. That is, by bringing the rotation support 3 into contact with the inner wall surfaces of the accommodation groove 211 by the ribs 31 on the opposite side walls of the rotation support 3, a contact area between the rotation support 3 and the inner wall surfaces of the accommodation groove 211 can be reduced to decrease a friction between the rotation support 3 and the inner wall surfaces of the accommodation groove 211, thereby facilitating the disassembly of the rotation support 3. In addition, a structural strength of the rotation support 3 can be increased by the ribs 31.

As illustrated in FIG. 5 to FIG. 8, in some embodiments of the present disclosure, two ribs 31 that are spaced apart from each other are disposed on each of the opposing side walls of the rotation support 3. Each of the two ribs 31 is brought into contact with an inner wall surface of the accommodation groove 211 at a corresponding side thereof, thereby reducing the contact area between the rotation support 3 and the inner wall surfaces of the accommodation groove 211 while firming the engagement between the rotation support 3 and the accommodation groove 211. In addition, the structural strength of the rotation support 3 can be increased by the ribs 31. By arranging the two ribs 31 to be space apart from each other, a mould opening of the rotation support 3 is easy, such that the molten adhesive material can flow easily, thereby facilitating fabrication and processing of the rotation support 3.

Of course, it should be understood that the number of the ribs 31 on each side wall of the rotation support 3 is not limited to two, and may be set based on as desired. For example, three or more ribs 31 may be arranged on each side wall of the rotation support 3.

In some embodiments of the present disclosure, the rib 31 has a guide chamfer 311 provided at a lower end thereof. The guide chamfer 311 can allow the rotation support 3 to be easily mounted into the accommodation groove 211, and thus the disassembly of the rotation support 3 is more convenient.

As illustrated in FIG. 5 to FIG. 8, in some embodiments of the present disclosure, the rotation support 3 has a sealing plate 32 provided on each of the opposite side walls thereof, and the sealing plate 32 extends towards the inner wall surface of the accommodation groove 211 at the corresponding side thereof and is located above the rib 31 on the corresponding side. It should be understood that, due to the rib 31 between the rotation support 3 and the inner wall surfaces of the accommodation groove 211, a gap is formed between the rotation support 3 and the inner wall surfaces of the accommodation groove 211, resulting in an entry of the water into the gap. By arranging the sealing plate 32 on each of the opposite side walls of the rotation support 3 and positioning each sealing plate 32 above the rib 31 on the corresponding side, the gap can be blocked by the sealing plate 32 to prevent the water from entering the gap. Specifically, the sealing plate 32 may be brought into contact with the inner wall surface at the corresponding side of the accommodation groove 211 to effectively prevent the water from entering the gap.

In some embodiments of the present disclosure, the sealing plate 32 is connected to the rib 31 to increase the structural strength of the rotation support 3.

As illustrated in FIG. 5 to FIG. 8, in some embodiments of the present disclosure, the fixation member 1 includes two engagement protrusions 12 that are spaced apart from each other, each of which is configured to be rotatably engaged with the rotation support 3. In this way, the pivoting shaft 10 and a positioning protrusion 41 can be easily arranged such that the fixation member 1 can be easily engaged with the rotation support 3 to rotate relative to the rotation support 3. Therefore, during transportation of the window air conditioner 200, the fixation member 1 may be rotated to receive the sealing assembly 100 in the accommodation groove 211, which is conducive for the transportation of the window air conditioner 200.

In some embodiments of the present disclosure, each engagement protrusion 12 has a hollow member provided thereon. That is, the engagement protrusion 12 has a hollow structure to facilitate a mould opening of the engagement protrusion 12 in such a manner that uniformity of a wall thickness of the engagement protrusion 12 can be ensured to allow the molten adhesive material to flow easily, and therefore, to facilitate the fabrication and processing of the fixation member 1.

In some embodiments of the present disclosure, each engagement protrusion 12 has a reinforcing rib 121 provided within the hollow member thereof. That is, by arranging the reinforcing rib 121, a structural strength of the engagement protrusion 12 can be improved, the pivoting shaft 10 can be supported by the reinforcing rib 121 to improve a strength of the pivoting shaft 10.

As illustrated in FIG. 5 to FIG. 8, in some embodiments of the present disclosure, the sealing assembly 100 further includes an angle positioning assembly 4 configured to cooperate with each of the rotation support 3 and the fixation member 1 to position the fixation member 1 at a predetermined angle when the fixation member 1 is rotated to the predetermined angle. In this way, the fixation member 1 can be positioned at a specific angle. For example, an included angle between the fixation member 1 and a horizontal direction may be 90°, 45°, or 30°. Therefore, a rotation angle of the fixation member 1 can be determined by a user as desired, thereby improving use performance of the sealing assembly 100.

As illustrated in FIG. 5 to FIG. 8, in some embodiments of the present disclosure, the angle positioning assembly 4 includes the positioning protrusion 41 and a plurality of positioning grooves 42. The positioning protrusion 41 is disposed on the fixation member 1. The plurality of positioning grooves 42 are arranged on the rotation support 3 in a circular shape. The positioning protrusion 41 can be engaged with the plurality of positioning grooves 42 in a switchable manner when the fixation member 1 is rotated. The positioning protrusion 41 may be engaged with one of the plurality of positioning grooves 42 to position the fixation member 1. In this way, the rotation angle of the fixation member 1 can be determined by the positioning protrusion 41 and the plurality of positioning grooves 42, which is convenient to improve reliability and stability of positioning of the fixation member 1.

Further, the plurality of positioning grooves 42 may be arranged in the circular shape. The positioning protrusion 41 may be engaged with the plurality of positioning grooves 42 in the switchable manner when the fixation member 1 is rotated. The positioning protrusion 41 may be engaged with one of the plurality of positioning grooves 42 to position the fixation member 1.

For example, a plurality of positioning protrusions 41 are provided and arranged in a ring shape (e.g., a circular ring shape). The plurality of positioning protrusions 41 are configured to be engaged with the plurality of positioning grooves 42 in one-to-one correspondence. In this manner, a more balanced force can be exerted on the angle positioning assembly 4 to facilitate improving a structural strength of the angle positioning assembly 4, thereby facilitating improving positioning reliability and accuracy of the angle positioning assembly 4.

A window air conditioner according to embodiments in a second aspect of the present disclosure will be described below with reference to the accompanying drawings.

As illustrated in FIG. 1 to FIG. 9, the window air conditioner 200 is configured to be supported at a window 310 in a wall body 300. The window 310 has a movable window sash 400 provided therein. The window air conditioner 200 includes a casing 210 and a sealing assembly 100. The casing 210 has an accommodation groove 211 formed therein. The window sash 400 is adapted to at least partially extend into the accommodation groove 211. The sealing assembly 100 is the sealing assembly 100 according to the above embodiments of the present disclosure and is adapted to be sealingly arranged between the window sash 400 and an inner wall of the window 310.

In the window air conditioner 200 according to the embodiments of the present disclosure, by sealingly arranging the sealing member 2 between the window sash 400 and the inner wall of the window 310, on the one hand, the sealing assembly 100 has improved sealing performance, and on the other hand, the sealing assembly 100 has a good sound insulation effect. In addition, the sealing member 2 can be cut based on the distance between the side wall surface of the casing 210 and the inner wall surface of the window 310, such that the sealing member 2 can be mounted more conveniently, which in turn simplifies a structure of the sealing assembly 100.

Figure 9:
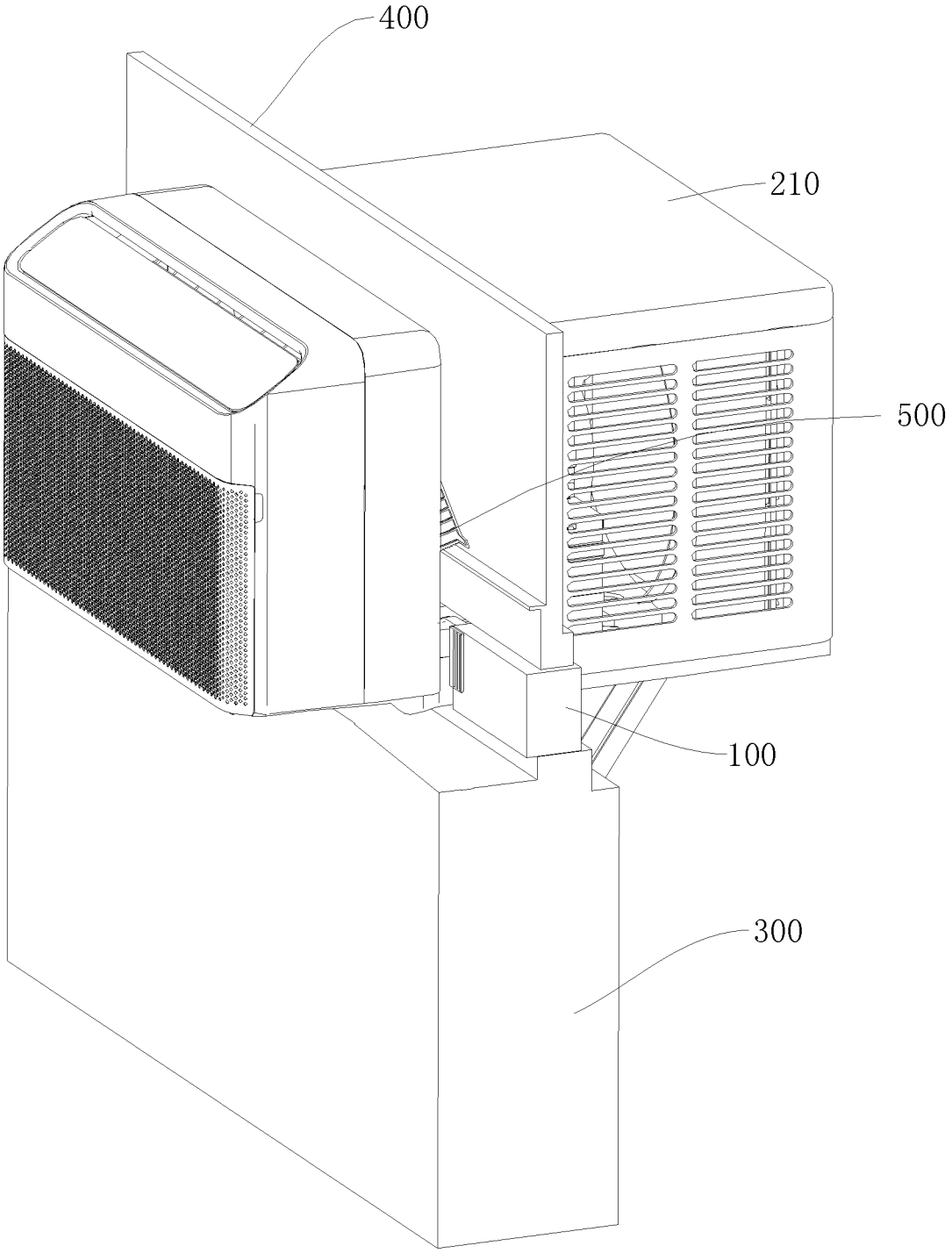
FIG. 9 is a schematic structural perspective view of a window air conditioner having a positioning device according to an embodiment of the present disclosure.

As illustrated in FIG. 9, the window air conditioner 200 further includes a positioning device 500 having an unlocked state in which the positioning device 500 is separated from the window sash 400 and a locked state in which the positioning device 500 is brought into contact with the window sash 400 to position the window sash 400, thereby facilitating positioning and locking of the window sash 400 to improve safety. In some embodiments of the present disclosure, the positioning device 500 is rotatable to lock or unlock the window sash 400, such that the positioning device 500 has a simpler and more reliable structure.

In some embodiments of the present disclosure, the casing 210 may be connected to the wall body 300 by a bracket to implement a more secure connection between the window air conditioner 200 and the wall body 300.

As illustrated in FIG. 1 to FIG. 5, in some embodiments of the present disclosure, the casing 210 includes a base 212, a rear housing 213, a front housing 214, and a middle partition plate 215. The rear housing 213 is fixed at the base 212 and configured to accommodate an outdoor heat exchanger therein. The front housing 214 is fixed at the base 212 and arranged to be spaced apart from the rear housing 213 in a forward-and-backward direction to form the accommodation groove 211. In this way, the accommodation groove 211 is easily formed, such that not only the window air conditioner 200 conveniently cooperate with the window, but also the casing 210 can be processed and fabricated easily with improved aesthetic appearance beautifying.

Further, the middle partition plate 215 is fixed at the base 212 and located within the accommodation groove 211. The middle partition plate 215 is engaged with the rear housing 213 and the front housing 214 at a front end and a rear end thereof, respectively. In this way, the window sash 400 is easily abutted against the middle partition plate 215 at a lower surface thereof, which facilitates wiring and drainage of the window air conditioner 200, thereby improve operation reliability of the window air conditioner 200.

As illustrated in FIG. 1 to FIG. 5, in some embodiments of the present disclosure, the middle partition plate 215 has a placement space 2150 formed therein, and the placement space 2150 is opened at a top thereof. The rotation support 3 is received within the placement space 2150. The fixation member 1 has an accommodation space 216 formed therein. An outer edge of the placement space 2150 extends, in response to the sealing assembly 100 being rotated out of the accommodation groove 211, into the accommodation space 216 in such a manner that the sealing assembly 100 is substantially flush with the middle partition plate 215. In this way, the sealing assembly 100, in a state of sealing the window 310, can be parallel or substantially parallel to the base 212, such that a height of the sealing assembly, in the state of sealing the window 310, relative to the window 310 can be lowered, thereby further ensuring a sealing effect.

Some specific embodiments of a window air conditioner 1000 according to the embodiments of the present disclosure will be described below with reference to FIG. 10 to FIG. 18.

Figure 10:
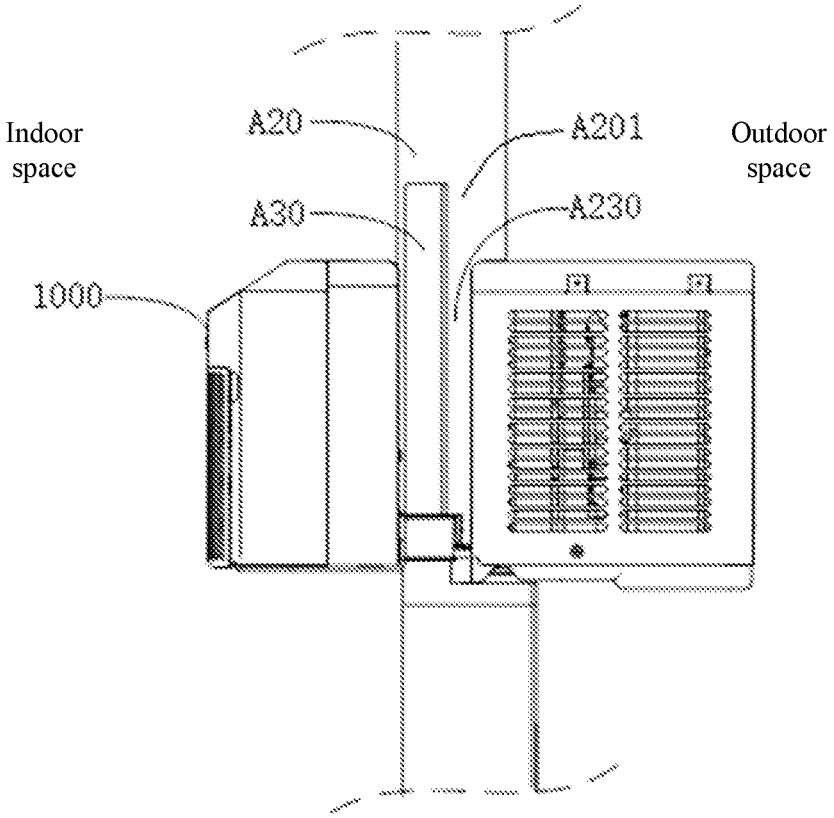
FIG. 10 is a schematic view showing a window air conditioner mounted on a wall body according to an embodiment of the present disclosure.
Figure 11:
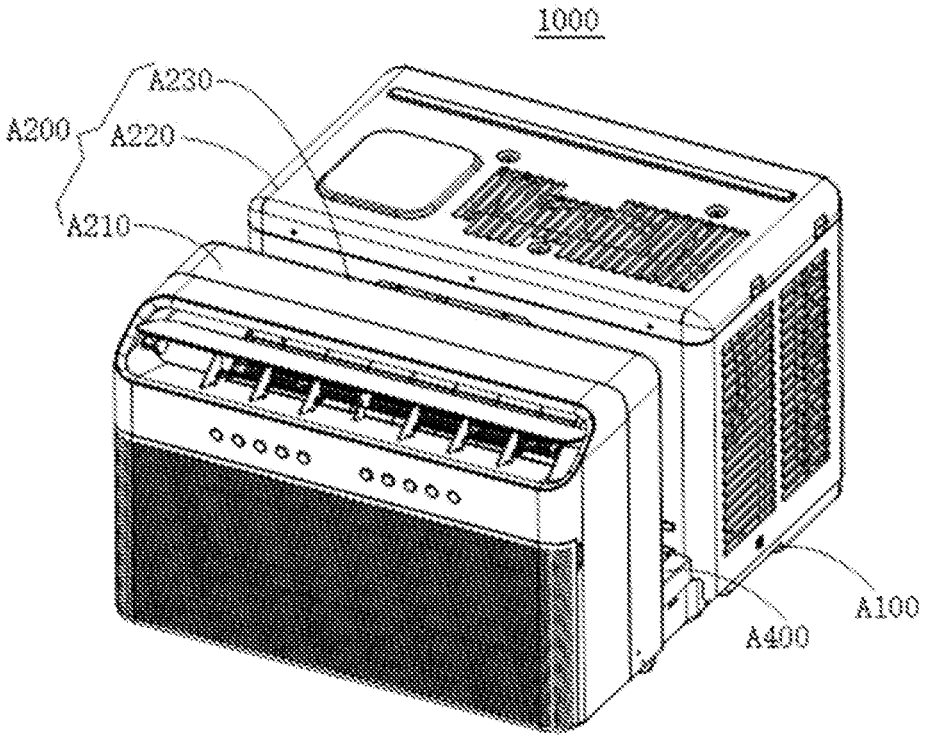
FIG. 11 is schematic structural view of the window air conditioner illustrated in FIG. 10.
Figure 12:
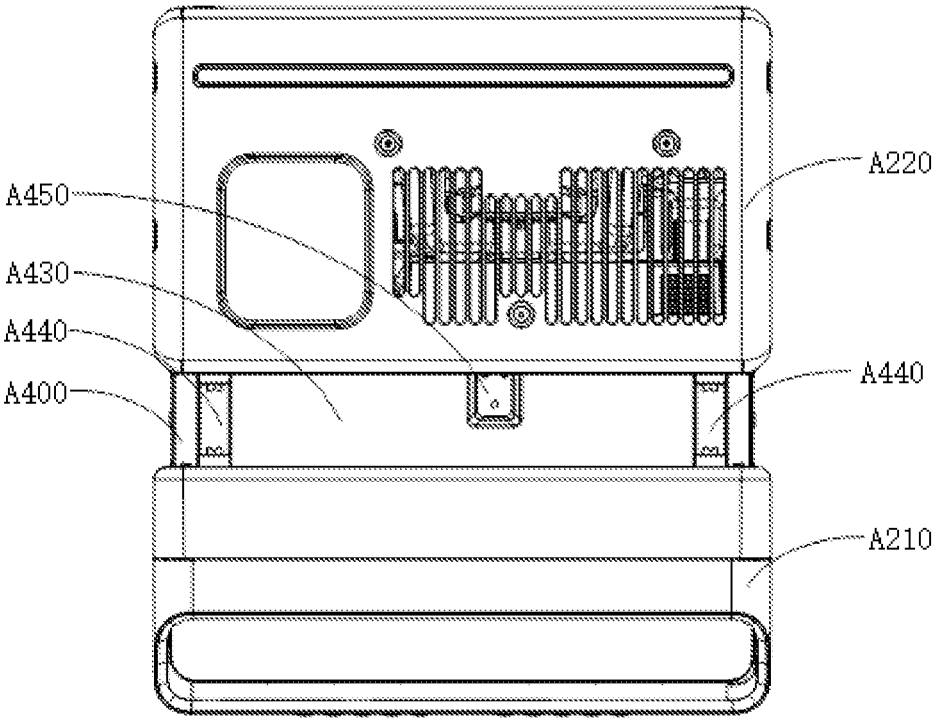
FIG. 12 is a top view of the window air conditioner illustrated in FIG. 10.
Figure 15:
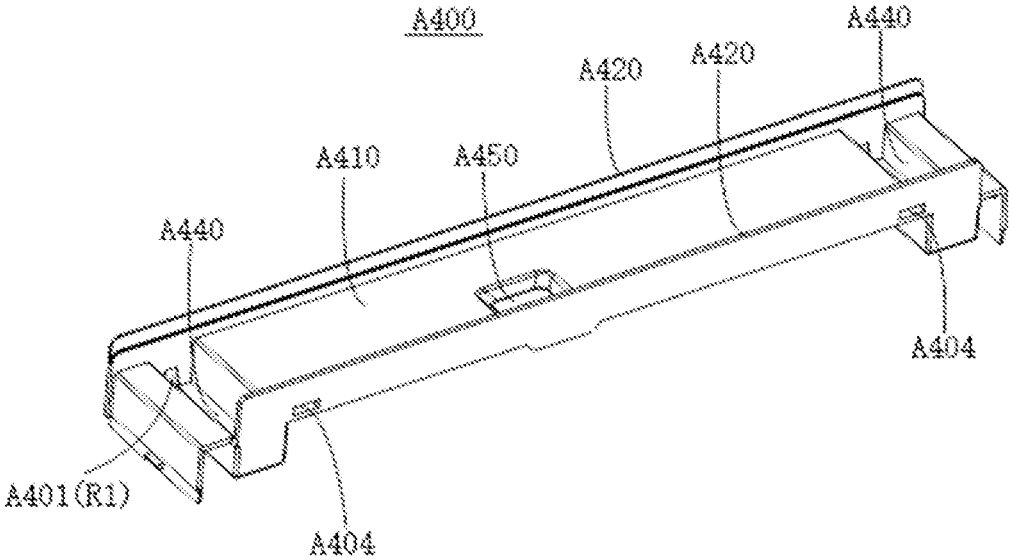
FIG. 15 is a schematic structural view of the middle partition plate illustrated in FIG. 14.

As illustrated in FIG. 10, the window air conditioner 1000 may be mounted at a window A201 in a wall body A20 for cooling or heating an indoor environment. The window air conditioner 1000 includes a base A100, a casing body A200 (excluding the base A100), and a middle partition plate A400. Here, the casing body A200 is formed on the base A100 and has an accommodation groove A230 formed therein. The accommodation groove A230 is adapted to allow an entrance of a window sash A30 located at the window A201 in the wall body A20. The middle partition plate A400 is mounted in the accommodation groove A230, and has a drainage hole R1 (for example, as illustrated in FIG. 15, a first drainage hole A401 and/or a second drainage hole A402, a third drainage hole A403, etc.) formed therein. The drainage hole R1 is adapted to drain water in the middle partition plate A400 to an outdoor side. For example, the middle partition plate A400 has a receiving groove A430 formed therein, and the drainage hole R1 is adapted to drain water in the receiving groove A430 to the outdoor side.

Specifically, the casing body A200 is divided into a front housing A210 and a rear housing A220 by the accommodation groove A230. The window air conditioner 1000 further includes a compressor, an outdoor heat exchanger, an outdoor fan, an indoor heat exchanger, and an indoor fan. Here, the compressor, the outdoor heat exchanger, and the outdoor fan are mounted within the rear housing A220, and the indoor heat exchanger and the indoor fan are mounted within the front housing A210.

After the window air conditioner 1000 is mounted at the window A201 in the wall body A20, the rear housing A220 of the window air conditioner 1000 is located outdoors, and the front housing A210 of the window air conditioner 1000 is located indoors. In this manner, noises generated by members at the outdoor side can be prevented from propagating to an indoor side, thereby achieving a noise reduction effect. Then, the window sash A30 is pulled downwardly to extend into the accommodation groove A230 of the window air conditioner 1000 until a lower edge of the window sash A30 extends into the middle partition plate A400. The window sash A30 can block a gap between both sides of the window air conditioner 200 and side walls of the window A201 to avoid a leakage of indoor cold or heated air from the gap to the outdoor space. It should be noted that the window sash A30 should be understood in a broad sense, and may also be replaced with a window louver, a curtain or the like that blocks light, or other protective window plates that can block an external object from entering the indoor space.

In the above process of mounting the window air conditioner 1000, compared with a window sash in the related art that can only be pulled up to a top surface of the window air conditioner 1000, the window sash A30 according to this embodiment can be inserted into the window air conditioner 1000. In this way, it is possible for the window sash A30 to block a space between the both sides of the window air conditioner 1000 and a bottom wall of the window A201, thereby increasing an occupation area of the window sash A30.

In the related art, since the window air conditioner 1000 is partially exposed to an outdoor environment, water (such as rainwater, condensed water or the like) in the outdoor environment may fall into the accommodation groove A230 and then overflow into an indoor room from a bottom portion of the accommodation groove A230. However, in the window air conditioner 1000 according to the present disclosure, the middle partition plate A400 is mounted at the bottom portion of the accommodation groove A230, and the drainage hole R1 is formed in the middle partition plate A400, such that the water in the outdoor environment may firstly fall onto the middle partition plate A400 via the accommodation groove A230, and then be discharged through the drainage hole R1 of the middle partition plate A400 to the outdoor side.

As for a fixing manner for the middle partition plate A400, the middle partition plate A400 may be connected and fixed to the base A100 or to the casing body A200. By taking the middle partition plate A400 being connected to the base A100 as an example, the middle partition plate A400 may be connected to the base A100 by any one or a combination of an insertion structure, a snapping connection structure, or a screw structure. The present disclosure is not limited in this regard.

In the technical solution of the present disclosure, by mounting the middle partition plate A400 in the accommodation groove A230 and forming the drainage hole R1 in the middle partition plate A400, the water in the outdoor environment falling into the middle partition plate A400 can be discharged through the drainage hole R1 to the outdoor side. Therefore, it can be seen that the window air conditioner 1000 of the present disclosure can decrease an overflowing of the water in the outdoor environment into the indoor room from the accommodation groove A230, thereby preventing the indoor room from being wet due to the water.

It is worth mentioning that, as mentioned above, the drainage hole R1 is adapted to drain water in the middle partition plate A400 to the outdoor side, in which "the outdoor side" may refer to the outdoor environment or a part of the base A100 corresponding to the outdoor side. For example, the middle partition plate A400 has a drainage hole R1 formed in an end surface thereof, through which the water is discharged to the outdoor environment directly from a side of the window air conditioner 1000 by a drainage pipe.

Alternatively, the middle partition plate A400 has a drainage hole R1 formed at the bottom portion thereof to drain water to a part of the base 100 corresponding to the outdoor side. Then, the water can be discharged from the base A100 to the outdoor environment, or spattered to the outdoor heat exchange by a water spattering wheel for dissipating heat of the outdoor heat exchanger.

Figure 13:
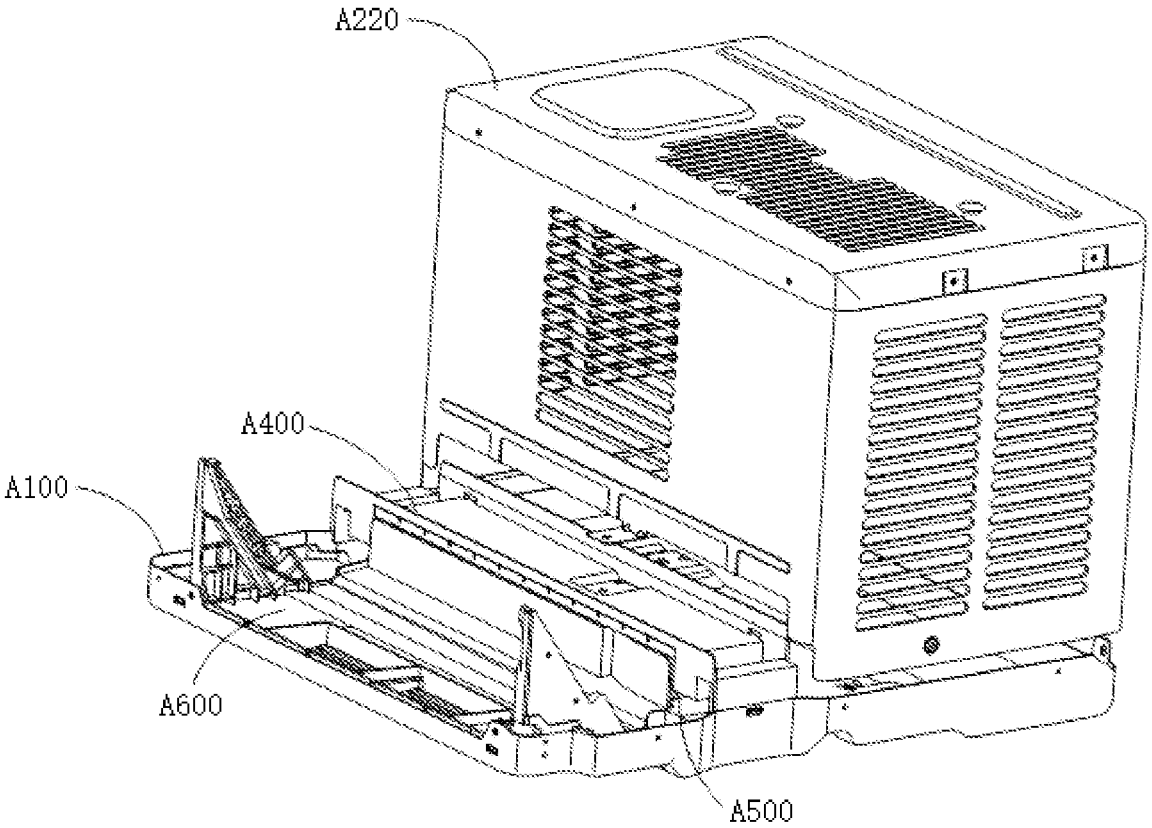
FIG. 13 is a schematic view showing a partial structure of the window air conditioner illustrated in FIG. 12.
Figure 14:
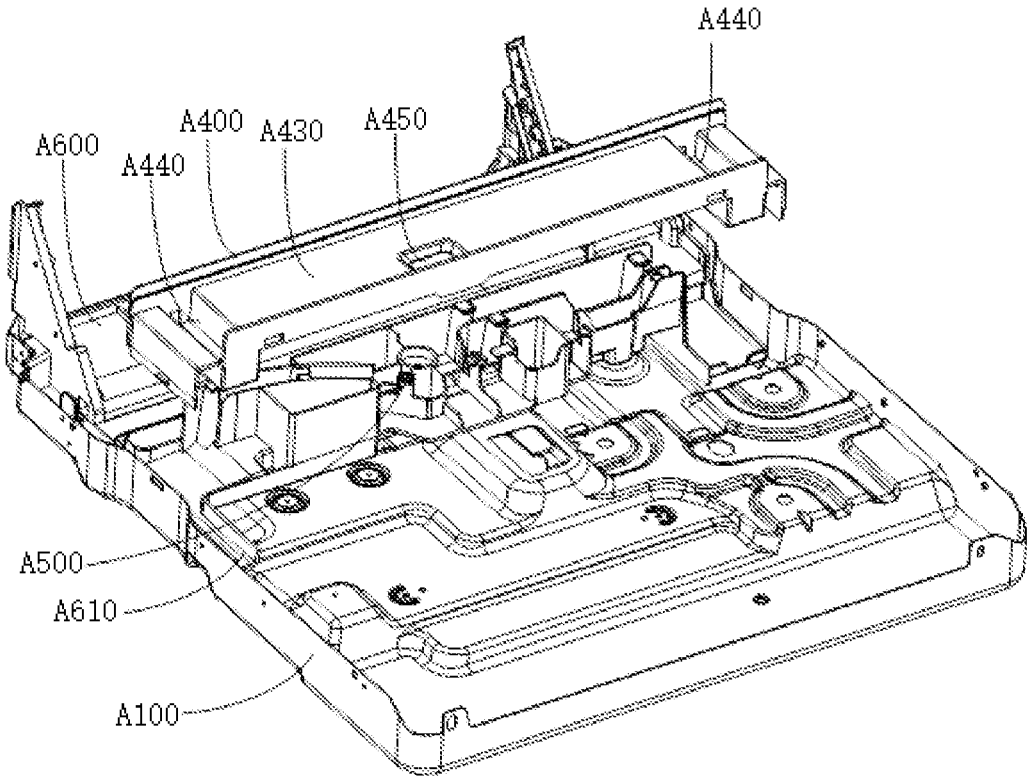
FIG. 14 is a schematic view showing an assembly of a middle partition plate and a base illustrated in FIG. 13.

In some embodiments of the present disclosure, as illustrated in FIG. 13 to FIG. 15, the middle partition plate A400 includes a bottom plate A410 and side plates A420 formed at opposite sides of the bottom plate. The receiving groove A430 is formed between the side plates A420 and the bottom plate A410, and the drainage hole R1 is adapted to drain water in the receiving groove 430 to the outdoor side. The receiving groove A430 of the middle partition plate A400 has a plurality of drainage holes R1 formed therein. At least a part of the plurality of drainage holes R1 is adapted to drain water to the part of the base A100 corresponding to the outdoor side. The plurality of drainage holes R1 are arranged at intervals in a length direction of the middle partition plate A400. The window air conditioner 1000 further includes a water receiving tray A600 mounted on the base A100. A part of the plurality of drainage holes R1 is adapted to drain water to the water receiving tray A600, and then the water is discharged from the water receiving tray A600 to an outdoor part of the base A100.

Specifically, it should be understood that a part of the plurality of drainage holes R1 on the middle partition plate A400 is configured to drain water directly to the part of the base A100 corresponding to the outdoor side, while another part of the plurality of drainage holes R1 is configured to drain water firstly to the water receiving tray A600, the water is then discharged from the water receiving tray A600 to the base A100.

Figure 16:
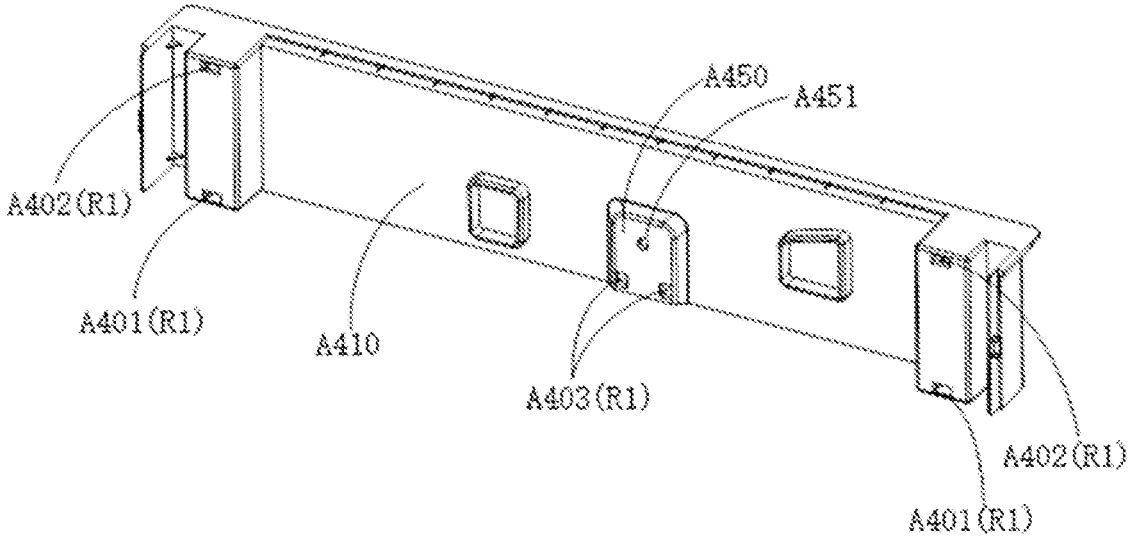
FIG. 16 is a schematic view of the middle partition plate illustrated in FIG. 15 viewed from another perspective.

As illustrated in FIG. 14 to FIG. FIG. 16, it is taken into consideration here that when the receiving groove A430 of the middle partition plate A400 contains a small amount of water, the water in the receiving groove A430 is dispersed without easily flowing into the drainage hole. To solve this problem, optionally, the receiving groove A430 is recessed downwardly at each of both ends thereof to form a placement space A440. The plurality of drainage holes R1 includes a first drainage hole A401 formed at one end of the placement space A440, and the first drainage hole A401 is adapted to drain water to the water receiving tray A600; and/or the plurality of drainage holes R1 includes a second drainage hole A402 formed at the other end of the placement space A440, and the second drainage hole A402 is adapted to drain water to the base A100.

Specifically, the middle partition plate A400 has the placement space A440 formed at each of both ends of the receiving groove A430. The placement space A440 is close to the front housing A210 at one end thereof and close to the rear housing A220 at the other end thereof. Therefore, the first drainage hole A401 is formed at the end of the placement space A440 close to the front housing A210, and located above the water receiving tray A600 to drain water to the water receiving tray A600. The second drainage hole A402 is formed at the end of the placement space A440 close to the rear housing A220, and located above the part of the base A100 corresponding to the outdoor side to drain water to the part of the base A100 corresponding to the outdoor side.

Further, in order to facilitate a flow of the water from the water receiving tray A600 to the base A100, as illustrated in FIG. 14, the water receiving tray A600 has a drainage groove A610 configured to drain water to the base A100, and the first drainage hole A401 is correspondingly located above the drainage groove A610. Therefore, when the water discharged from the first drainage hole A401 happens to fall into the drainage groove A610 of the water receiving tray A600 and then is discharged directly from the drainage groove A610 to the base A100, a drainage path is relatively short, which facilitates enhancing drainage efficiency.

Specifically, the water receiving tray A600 partially extends to a position below the middle partition plate A400 and has a drainage groove A610 at a part thereof located below the middle partition plate A400. In order to facilitate mounting of the middle partition plate A400, the part of the water receiving tray A600 located below the middle partition plate A400 also has a support member A500. The support member A500 is adapted to support the middle partition plate A400. The support member A500 and the water receiving tray A600 are formed into one piece. The middle partition plate A400 may be connected to the support member A500 by inserting the middle partition plate A400 into the support member A500, or through a screw structure, and the present disclosure is not limited in this regard.

With continued reference to FIG. 14 to FIG. 16, it is also taken into consideration here that when the receiving groove A430 of the middle partition plate A400 contains a large amount of water, the water may submerge the placement space A440 and possibly overflow from an upper peripheral edge of the receiving groove A430. To solve this technical problem, the receiving groove A430 is recessed downwardly in a middle portion thereof to form a recess A450. The plurality of drainage holes R1 further includes a third drainage hole A403 formed at a bottom portion of the recess A450 and adapted to drain water to the part of the base A100 corresponding to the outdoor side. Therefore, after the water submerges the placement space A440 of the middle partition plate A400, the water can also be discharged from the third drainage hole A403 to the base A100, thereby effectively increasing a drainage amount of the middle partition plate A400 and improving a drainage rate.

Since the receiving groove A430 is recessed downwardly in the middle portion thereof to form the recess A450, a stress of the bottom plate A410 of the middle partition plate A400 is dispersed at a position where the recess A450 is located, such that the bottom plate A410 has have a high strength and less prone to fracture at this position. Therefore, the recess A450 may have a fixation hole A451 passing through a bottom portion thereof. The fixation hole A451 is adapted to be connected and fixed to the water receiving tray A600 by a connection member. The connection member may be a screw or a pin-type structure. On this basis, the third drainage hole A403 is located on a periphery of the fixation hole A451 to avoid the third drainage hole A403 from being too close to the fixation hole A451 to reduce a strength of a plate surface around the fixation hole A451.

In some embodiments, as illustrated in FIG. 14 to FIG. 16, it is further taken into consideration that when the receiving groove A430 of the middle partition plate A400 contains a large amount of water that submerges the recess A450, individual drainage ports cannot drain such a large amount of water timely. Therefore, a side plate A420 of the middle partition plate A400 close to the rear housing A220 has a water overflowing hole A404 formed therein. The water overflowing hole A404 passes through the side plate A420 and is adapted to drain water to the part of the base A100 corresponding to the outdoor side.

Specifically, one or more water overflowing holes A404 may be provided. A plurality of water overflowing holes A404 may be arranged at intervals in a length direction of the side plate A420. When a water level in the receiving groove A430 rises to reach the water overflowing hole A404, the water may be discharged from the water overflowing hole A404 towards the part of the base A100 corresponding to the outdoor side, thereby further increasing the drainage amount of the middle partition plate A400 and improving the drainage rate.

Figure 17:
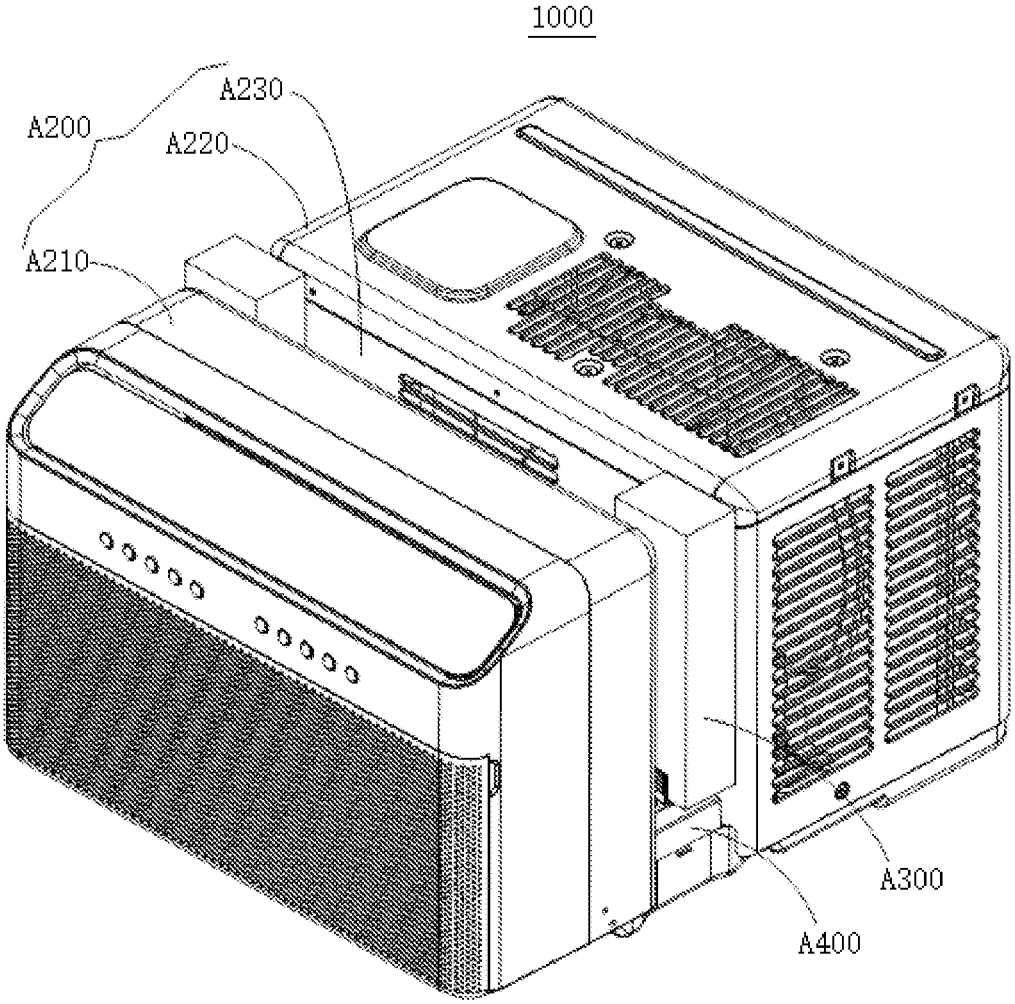
FIG. 17 is a schematic structural view of a window air conditioner according to another embodiment of the present disclosure, in which a sealing assembly is in a storage state.
Figure 18:
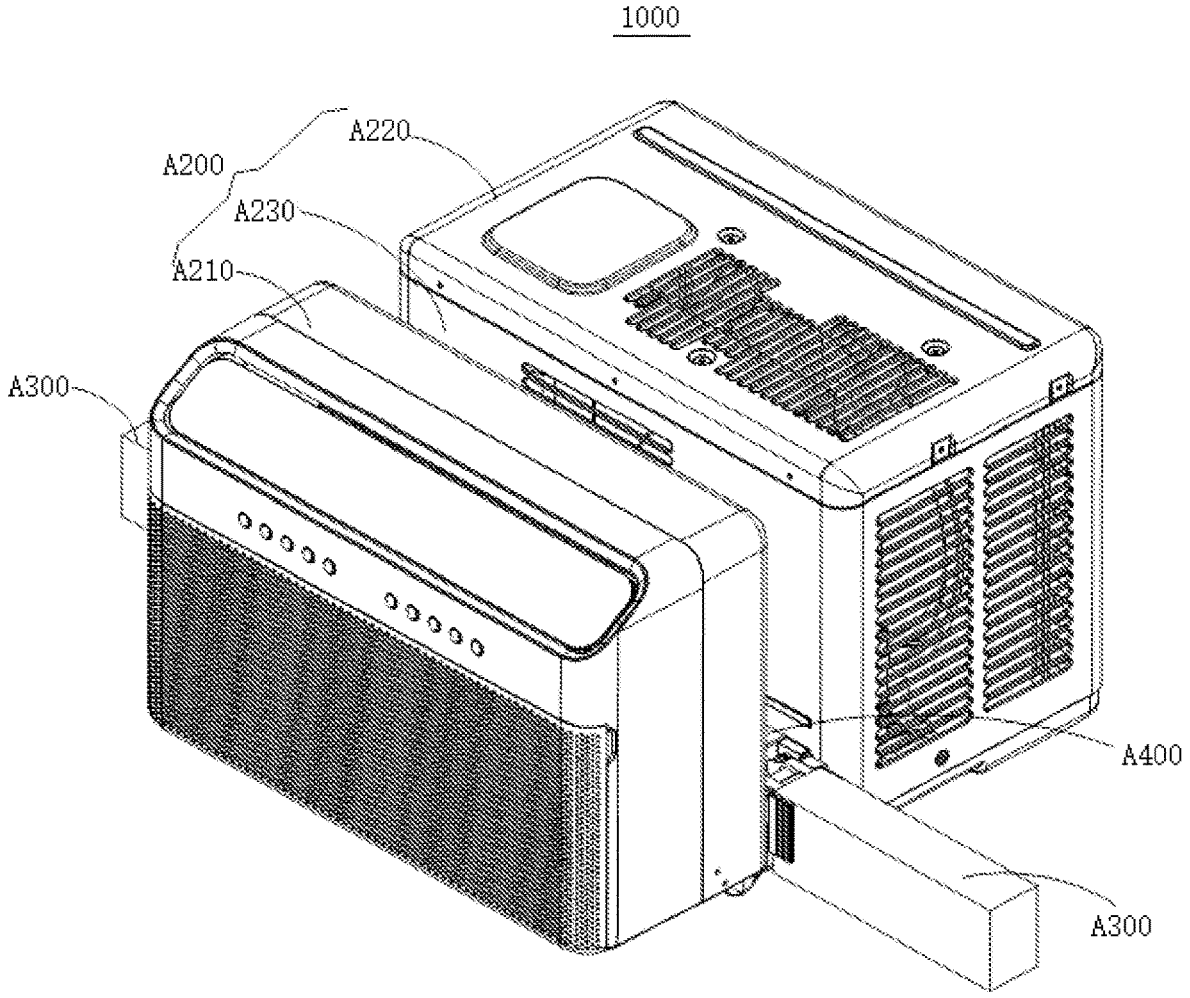
FIG. 18 a schematic view of the window air conditioner illustrated in FIG. 17 with the sealing assembly switched to an operation state.

As illustrated in FIG. 17 and FIG. 18, based on any one of the above embodiments, the window air conditioner 1000 further includes a sealing assembly A300. The sealing assembly A300 is movably mounted on the middle partition plate A400, and is adapted to be switchable between a storage state and an operation state through a movement. Here, in the storage state, the sealing assembly A300 is received in the accommodation groove A230, and in the operation state, the sealing assembly A300 extends laterally from the accommodation groove A230 and is adapted to be abutted against the window sash A30 and/or an inner wall of the window A201.

After the window air conditioner 1000 is mounted at the window A201, the sealing assembly A300 is moved to the operation state in such a manner that the sealing assembly 300 extends laterally from the accommodation groove A230 of the window air conditioner 1000 with a bottom surface of the sealing assembly A300 abutted against the bottom wall of the window A201. Then, the window sash A30 is pulled downwardly to extend into the accommodation groove A230 of the window air conditioner 1000 until the lower edge of the window sash A30 is brought into contact and abuts with each of the middle partition plate A400 and the sealing assembly A300. The sealing assembly A300 is filed in a gap between the window sash A30 and the bottom wall of the window A201 and seals the gap to reduce an amount of cold or heated air that leaks from the indoor space to the outdoor space through the gap. When the window air conditioner 1000 is not needed or is transported, the sealing assembly 300 is moved to the storage state to reduce a space occupied by the sealing assembly 300, thereby facilitating storage or packaging of the window air conditioner 1000.

Movable mounting for the sealing assembly 300 may be implemented in various ways. For example, the sealing assembly 300 may be slidably mounted on the middle partition plate A400. Alternatively, the sealing assembly 300 may be rotatably mounted on the middle partition plate A400. Additionally, alternatively, the sealing assembly 300 may be mounted on the middle partition plate A400 in a resiliently retractable manner. Specifically, the sealing assembly 300 herein is rotatably connected to the middle partition plate A400 to allow the sealing assembly 300 to be switchable between the operation state and the storage state through a rotation. Specifically, the sealing assembly 300 is rotatably mounted in the placement space A440 (as illustrated in FIG. 15) at one end thereof in such a manner that the sealing assembly 300 is rotatable relative to the middle partition plate A400 and switchable between the storage state and the operation state through the rotation.

Some specific embodiments of a window air conditioner 2000 according to the embodiments of the present disclosure will be described below with reference to FIG. 19 to FIG. 27.

Figure 19:
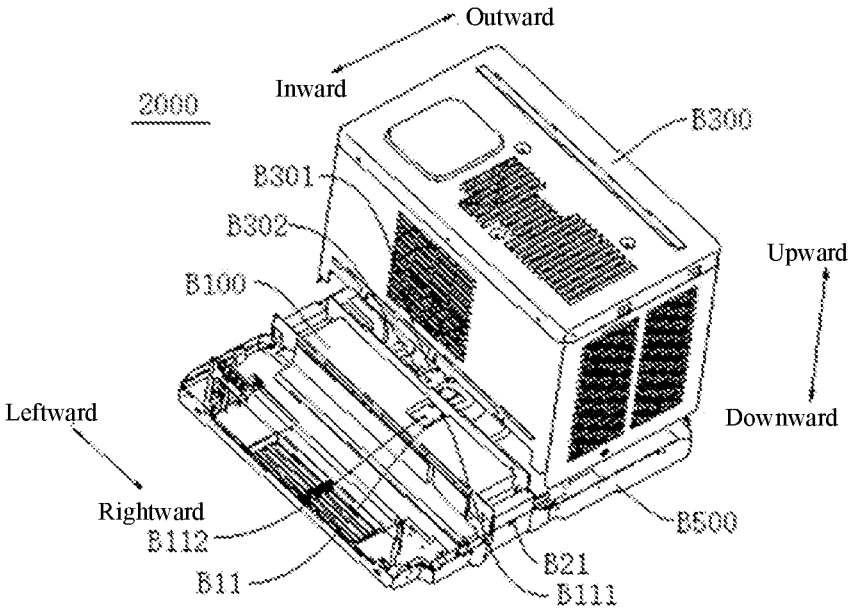
FIG. 19 is a partial schematic view of a window air conditioner according to an embodiment of the present disclosure.

As illustrated in FIG. 19, the window air conditioner 2000 is adapted to be supported at a window in a wall body. The window has a movable window sash provided therein. The window sash is movably disposed within the window in an upward-downward direction to open or close the window. The window air conditioner 2000 further includes a base assembly B500, a rear housing B300, and a front housing B200. Both the rear housing B300 and the front housing B200 are arranged on the base assembly B500. A middle partition plate B100 is connected between the rear housing B300 and the front housing B200, and may be located below the window sash. The front housing B200 is located at an inner side of the window. The rear housing B300 is located at an outer side of the window. The middle partition plate B100 may be connected to the front housing B200 and the rear housing B300 at both ends in a width direction thereof (e.g., an inward-outward direction illustrated in FIG. 19), respectively.

The middle partition plate B100 includes a partition plate body B1. A recess B11 opened at a top thereof is formed in the partition plate body B1 and recessed downwardly. The recess B11 has a third drainage hole B111 formed therein and a connection hole B112 that is configured to be connected to an outer housing 300 of the window air conditioner 2000. The third drainage hole B111 is in communication with the base assembly B500.

Figure 20:
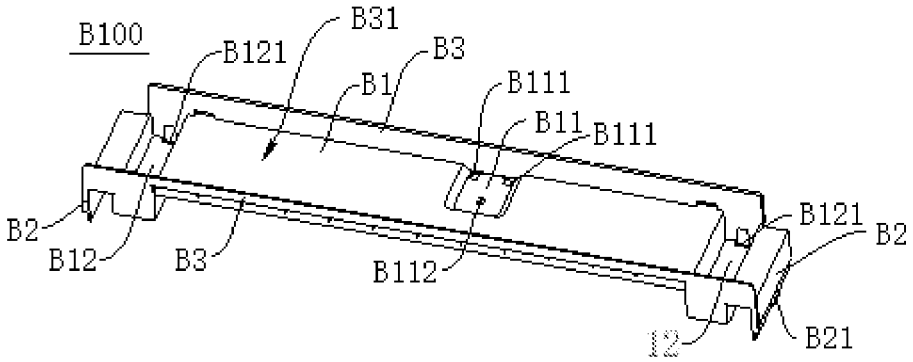
FIG. 20 is a schematic view of a middle partition plate illustrated in FIG. 19.

Referring to FIG. 19 and FIG. 20, the recess B11 may be formed by recessing a part of a surface of the partition plate body B1 downwardly. The recess B11 may be arranged adjacent to the rear housing B300. Both the connection hole B112 and the third drainage hole B111 pass through a bottom wall of the recess B11. Specifically, the window air conditioner 2000 may have a mounting lug B301 provided on the rear housing B300 thereof. The mounting lug B301 has a mating hole B302 formed therein. The mating hole B302 cooperates with the connection hole B112. The mounting lug B301 may be attached at a position below the recess 11. Therefore, a fixation piece may pass through and received within the connection hole B112 and the mating hole B302, such that the middle partition plate B100 can be conveniently and firmly fixed to the rear housing B300, thereby improving reliability and stability of a connection between the middle partition plate B100 and the rear housing B300 as well as assembly efficiency.

Also, rainwater and the like flowing down from the window sash when it rains may flow to the recess B11 in the partition plate body B1 and flow to the base assembly B500 through the third drainage hole B111, thereby preventing the rainwater flowing down from the window sash from entering the indoor space, which in turn prevents a floor and articles in the indoor space from getting wet and damaged. Therefore, safety and reliability of the window air conditioner 2000 can be improved.

It should be understood that water discharged from the third drainage hole B111 may flow to the base assembly B500, and be discharged through the base assembly B500 to the outdoor space when the water in the base assembly B500 has gathered to a certain amount. Alternatively, the water discharged from the third drainage hole B111 may be directly discharged through the base assembly B500 to the outdoor space.

In some embodiments of the present disclosure, the base assembly B500 includes a base and a water receiving tray. The water receiving tray is disposed on the base and located below the middle partition plate B100. Here, the third drainage hole B111 may be in communication with the water receiving tray. In this manner, the water discharged from the third drainage hole B111 can flow into the water receiving tray, thereby avoiding dampness of other members on the base caused by the water discharged from the third drainage hole B111, and improving the safety and reliability of the window air conditioner 2000.

Therefore, by arranging the recess B11 in the partition plate body B1 and forming the connection hole B112 and the third drainage hole B111 in a mounting slot, the middle partition plate B100 can be conveniently and firmly fixed to the rear housing B300, thereby enhancing the reliability and stability of the connection between the middle partition plate B100 and the rear housing B300, and increasing the assembly efficiency. In addition, the rainwater and the like flowing down from the window sash when it rains may flow to the recess B11 in the partition plate body B1 and be discharged to the base assembly B500 through the third drainage hole B111, thereby preventing the rainwater flowing down from the window sash from entering the indoor space, which in turn prevents the floor and articles in the indoor space from getting wet and damaged. Therefore, safety and reliability of the window air conditioner 2000 can be improved.

Figure 21:
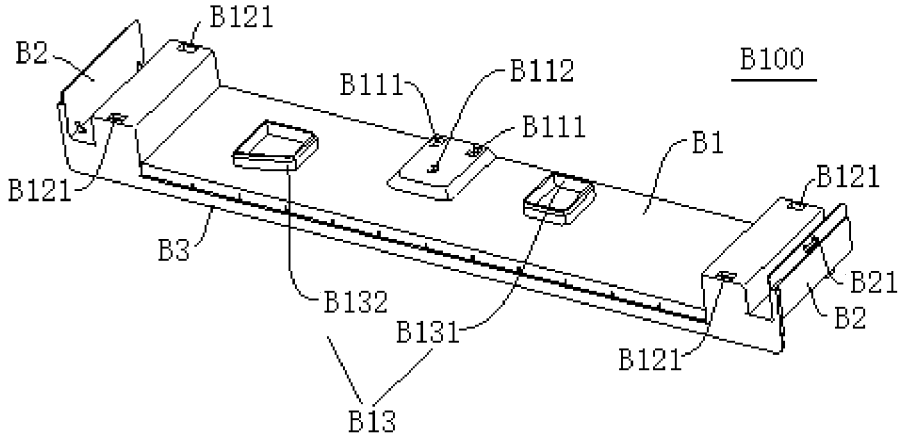
FIG. 21 is another schematic view of the middle partition plate illustrated in FIG. 19.

According to some embodiments of the present disclosure, the partition plate body B1 has a placement space B12 formed in each of two ends in a length direction thereof. Referring to FIG. 20 and FIG. 21, the placement space B12 may be formed by recessing a part of the surface of the partition plate body B1 downwardly. The first drainage hole B121 is formed in the placement space B12 with in communication with the base assembly B500. The first drainage hole B121 may pass through a bottom wall of the placement space B12 to drain water from the placement space B12 timely.

It should be understood that the water discharged from the first drainage hole B121 may flow into the base assembly B500, and be discharged through the base assembly B500 to the outdoor space when the water in the base assembly B500 has gathered to a certain amount. Alternatively, the water discharged from the first drainage hole B121 may be directly discharged through the base assembly B500 to the outdoor space. Therefore, by arranging the first drainage hole B121 in the placement space B12, discharging water gathered on the partition plate body B1 to the outdoor space can be speeded up, such that the gathering of water on the partition plate body B1 can be avoided, thereby preventing the water on the partition plate body B1 from flowing into the indoor space.

In some embodiments of the present disclosure, the base assembly B500 includes a base and a water receiving tray. The water receiving tray is disposed on the base and located below the middle partition plate B100. Here, the first drainage hole B121 may be in communication with the water receiving tray. In this manner, dampness of other members on the base caused by the water discharged from the first drainage hole B121 can be avoided, thereby improving the safety and reliability of the window air conditioner 2000.

Here, the placement space B12 may be configured to mount a sealing assembly B400 of the window air conditioner 2000. The sealing assembly B400 is adapted to be in contact with the window sash and the inner wall of the window, respectively. It should be understood that in a state of the window sash closing the window, the sealing assembly B400 is brought into contact with the window sash at one side thereof and with the inner wall of the window at the other side thereof, thereby improving sealing performance of the sealing assembly B400.

According to some embodiments of the present disclosure, the middle partition plate B100 further includes two end side plates B2. The two end side plates B2 are connected to both ends of the partition plate body B1 in a length direction (e.g., a leftward-rightward direction illustrated in FIG. 19), respectively. Each of the two end side plates B2 has an snap buckle B21 provided thereon. The snap buckle B21 is connected to the base assembly B500 of the window air conditioner 200. For example, referring to FIG. 19 and FIG. 20, the two end side plates B2 may be connected to a left side and a right side of the partition plate body B1, respectively, with one end of each end side plate B2 being connected to the partition plate body B1 and the other end extending downwardly. The base assembly B500 has a buckle slot engaged with the snap buckle B21. Therefore, the middle partition plate B100 can be easily connected to the base assembly B500 to avoid a movement of the middle partition plate B100, thereby improving position stability of the middle partition plate B100.

According to some embodiments of the present disclosure, the base assembly B500 has a socket provided thereon, and the partition plate body B1 has a positioning member B13 provided on a bottom surface thereof. The positioning member B13 is adapted to be engaged with the socket. During assembling, positioning of the middle partition plate B100 can be implemented through the engagement between the socket and the positioning member B13, which effectively lowers a difficulty of assembling the middle partition plate B100 and improves assembly efficiency of the middle partition plate B100.

For example, in some specific embodiments of the present disclosure, the positioning member B13 may be a positioning bump formed on a bottom surface of the partition plate body B1 or a positioning groove formed in the base assembly B500. Here, when the base assembly B500 includes the base and the water receiving tray, the socket may be formed on the water receiving tray. Therefore, the positioning of the middle partition plate B100 can be implemented through an engagement between the positioning bump and the positioning groove. Such a structure is simple and can implement positioning easily.

According to some embodiments of the present disclosure, the positioning member B13 includes a first positioning member B131 and a second positioning member B132 that are spaced apart from each other and have different outer contour shapes. In this manner, during assembling, only when the first positioning member B131 is engaged with the socket corresponding to the first positioning member B131 and the second positioning member B132 is engaged with the socket corresponding to the second positioning member B132, the middle partition plate B100 can be assembled on the base assembly B500. Therefore, fool proofing can be implemented by the first positioning member B131 and the second positioning member B132 that have different outer contours to prevent the middle partition plate B100 from being mounted in a reverse direction, which is conducive to improving assembly efficiency.

According to some embodiments of the present disclosure, as illustrated in FIG. 21, the first positioning member B131 is formed into a square bump, and the second positioning member B132 is formed into a trapezoidal bump. Such a structure is simple and easy to be processed. Of course, it should be understood that the first positioning member B131 and the second positioning member B132 may also be formed into other shapes such as a triangle, a circle, an irregular shape, etc., as long as the outer contour shape of the first positioning member B131 is different from that of the second positioning member B132.

According to some embodiments of the present disclosure, as illustrated in FIG. 20 and FIG. 21, the middle partition plate B100 also includes two side plates B3 that are connected to both ends of the partition plate body B1 in a width direction, respectively. A receiving groove B31 is formed between the two side plates B3 and the partition plate body B1. The receiving groove B31 is configured to store the rainwater flowing down from the window sash. When a large amount of rainwater flows down from the window sash rapidly, the rainwater can be temporarily stored in the receiving groove B31 to prevent, when too much water gathered in the recess B11 cannot be discharged timely, the water from flowing into the indoor space, thereby improving safety and reliability of the window air conditioner 2000.

According to some embodiments of the present disclosure, the middle partition plate B100 is made of plastic. Plastic facilitates mass production due to its light weight and low cost, thereby enhancing fabrication efficiency and lowering the cost of the middle partition plate B100.

Figure 22:
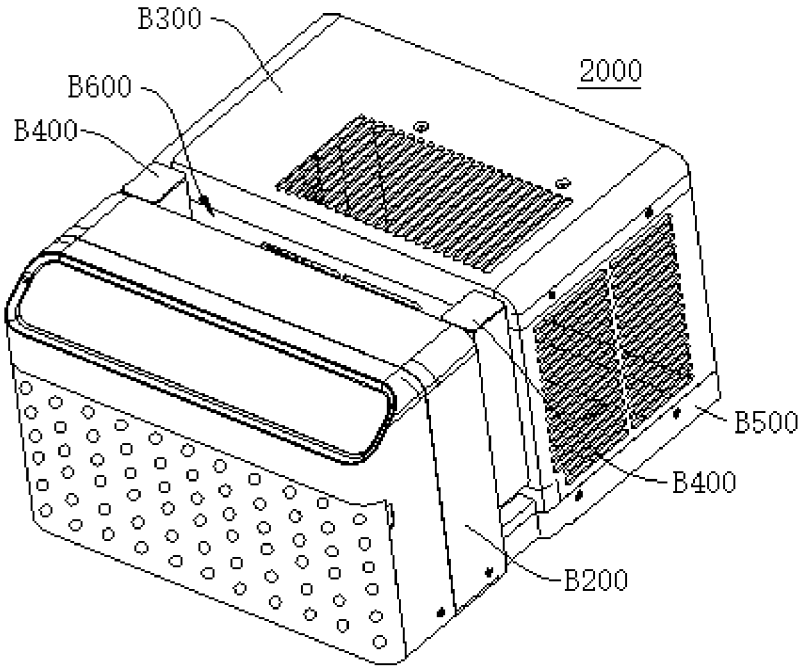
FIG. 22 is a perspective view of the window air conditioner illustrated in FIG. 19.
Figure 23:
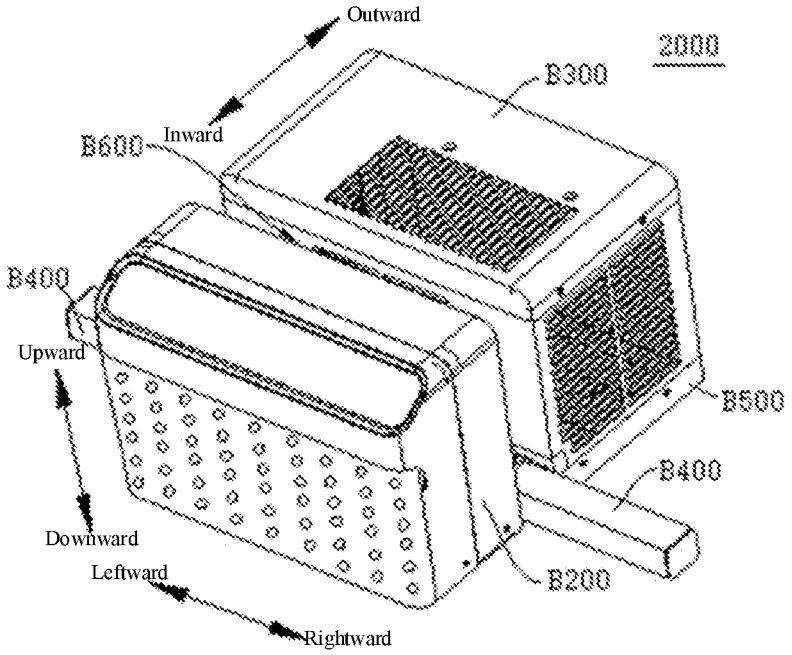
FIG. 23 is another perspective view of the window air conditioner illustrated in FIG. 22.

As illustrated in FIG. 22 and FIG. 23, the window air conditioner 2000 includes the base assembly B500, the rear housing B300, the front housing B200, the middle partition plate B100, and the fixation piece. The rear housing B300 is arranged on the base assembly B500. The front housing B200 is arranged on the base assembly B500. The front housing B200 and the rear housing B300 are spaced apart from each other to form an accommodation groove B600. Here, the window sash may be arranged in the accommodation groove B600. The middle partition plate B100 is arranged on the base assembly B500 and located between the rear housing B300 and the front housing B200. The rear housing B300 has the mounting lug B301 provided thereon. The mounting lug B301 has the mating hole B302 formed therein. The mating hole B302 corresponds to the connection hole B112. The fixation piece may pass through the connection hole B112 and the mating hole B302.

The mounting lug B301 may be attached at a position below the recess B11. Therefore, the fixation piece may pass through and received within the connection hole B112 and the mating hole B302, such that the middle partition plate B100 can be conveniently and firmly fixed to the rear housing B300, thereby improving reliability and stability of the connection between the middle partition plate B100 and the rear housing B300 as well as the assembly efficiency. In addition, the rainwater and the like flowing down from the window sash when it rains may flow to the recess B11 in the partition plate body B1 and be discharged through the third drainage hole B111, thereby preventing the rainwater flowing down from the window sash from entering the indoor side, which in turn improves the safety and reliability of the window air conditioner 2000.

According to some embodiments of the present disclosure, the window air conditioner 2000 is adapted to be supported at the window in the wall body. The window has the movable window sash provided therein. The partition plate body B1 has the placement space B12 formed at each of the two ends thereof in the length direction. The window air conditioner 2000 further includes the sealing assembly B400. The sealing assembly B400 includes a fixation member B401 and a sealing member B402. The fixation member B401 is connected to the placement space B12. The sealing member B402 is connected to the fixation member B401 and adapted to be sealingly arranged between the window sash and the inner wall of the window.

It should be understood that the sealing member B402 is connected into the placement space B12 by the fixation member B401. In the state of the window sash closing the window, the sealing member B402 is brought into contact with the window sash at one side thereof and with the inner wall of the window at the other side thereof to seal the window by the sealing member B402. Therefore, on the one hand, the sealing performance of the sealing assembly B400 is improved, and on the other hand, the sealing assembly B400 has a good sound insulation effect.

Optionally, the sealing assembly B400 corresponds to the placement space B12 one-to-one. Therefore, the structure of the window air conditioner 2000 can be simplified and the sealing performance and sound insulation effect of the window air conditioner 2000 can be improved.

Further, the sealing member B402 may have an adjustable length which can be cut on site based on the distance between the side wall surfaces of the front housing B200 and the rear housing B300 and the inner wall surface of the window, such that the sealing member B402 can provide better sealing to the window, thereby ensuring sealing of the window while the sealing assembly B400 has a simpler structure. For example, the sealing member B402 may be a sealing sponge.

According to some embodiments of the present disclosure, the fixation member B401 includes a rotation support B4011 and a mounting member B4012. The rotation support B4011 is fixed in the placement space B12. The mounting member B4012 is rotatably arranged on the rotation support B4011 in such a manner that the sealing assembly B400 is capable of being rotated to be received within the accommodation groove B600. In this way, it is possible to only facilitate mounting of the fixation member B401, but also facilitate a rotation of the mounting member B4012 relative to the rotation support B4011, such that the sealing assembly B400 is easily stored to reduce a space occupied by the sealing assembly B400.

Further, the mounting member B4012 has a pivoting shaft B4014 provided thereon, the rotation support B4011 has a pivoting hole B4015 formed therein, and the pivoting shaft B4014 and the pivoting hole B4015 are configured to be rotatably engaged with each other. In this manner, the pivoting shaft B4014 and the pivoting hole B4015 can be engaged with each other to facilitate a smooth rotation of the mounting member B4012 and an improvement of the reliability of the rotation of the mounting member B4012.

According to some embodiments of the present disclosure, the mounting member B4012 has a mounting groove B4013 formed therein, and a part of the sealing member B402 is mounted in the mounting groove B4013. Therefore, by fixing the part of the sealing member B402 in the mounting groove B4013, a connection structure between the sealing member B402 and the mounting member B4012 is simpler and more reliable.

Figure 24:
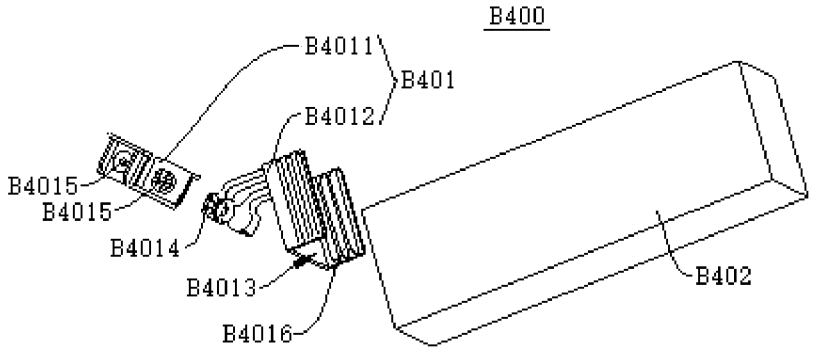
FIG. 24 is an exploded view of a sealing assembly illustrated in FIG. 23.
Figure 25:
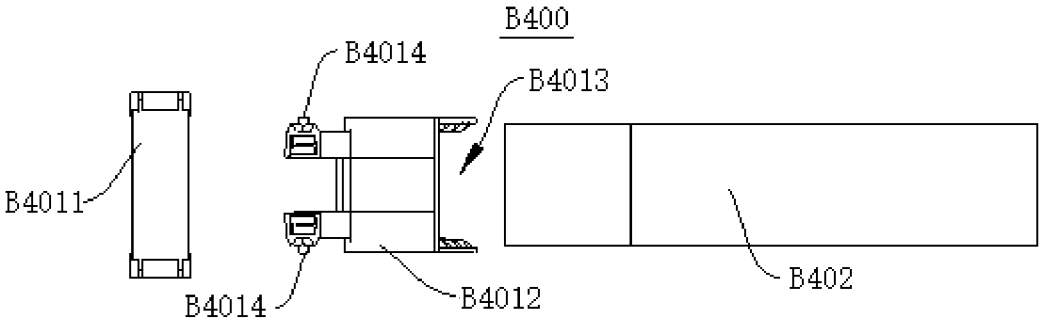
FIG. 25 is a top view of a sealing assembly illustrated in FIG. 24.
Figure 26:
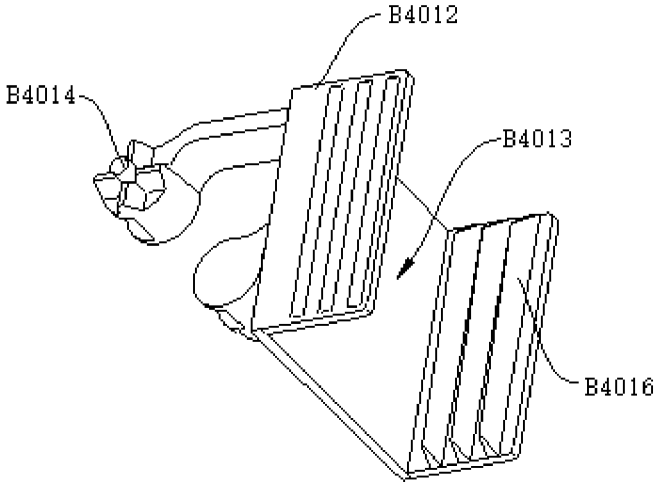
FIG. 26 is a schematic structural perspective view of a fixation member illustrated in FIG. 24.
Figure 27:
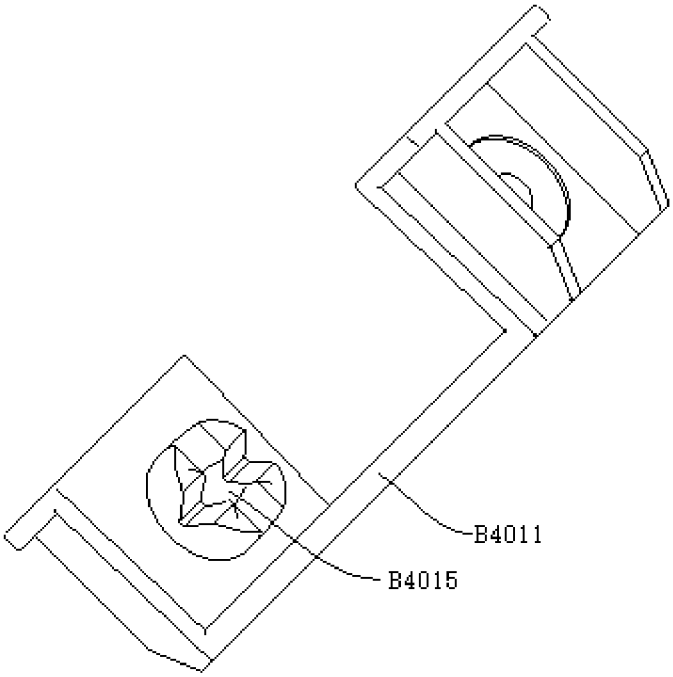
FIG. 27 is a schematic structural perspective view of a rotation support illustrated in FIG. 24.

As illustrated in FIG. 24 to FIG. 26, in some embodiments of the present disclosure, the mounting groove B4013 has a locking ridge B4016 provided on each of opposite side surfaces thereof, and the locking ridge B4016 is configured to be in contact with the sealing member B402 to position the sealing member B402 within the mounting groove B4013. In this manner, a strength of a connection between the sealing member B402 and the mounting member B4012 is improved, and the connection between the sealing member B402 and the mounting member B4012 is more stable and reliable.

Some specific embodiments of a window air conditioner 3000 according to the embodiments of the present disclosure will be described below with reference to FIG. 28 to FIG. 42.

Figure 28:
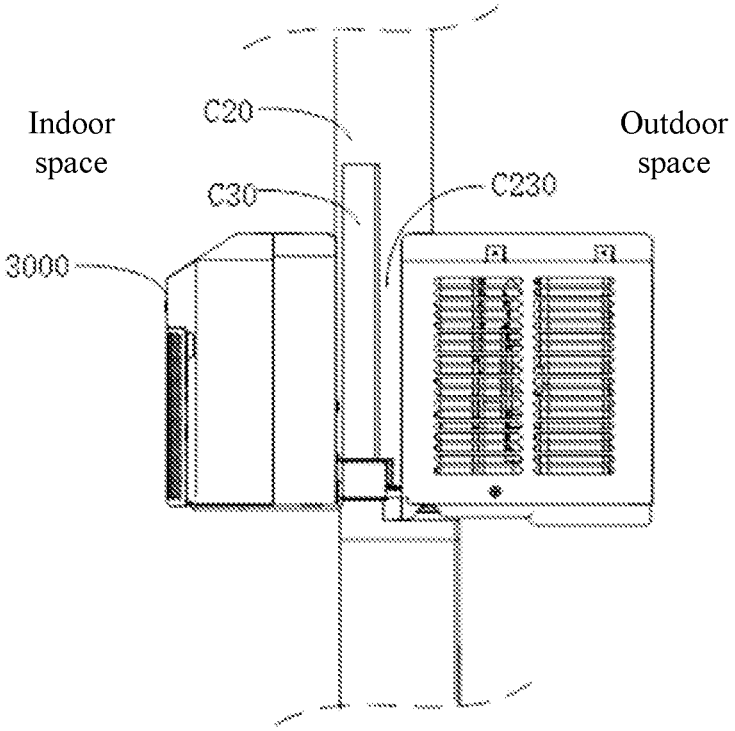
FIG. 28 is a schematic view showing a window air conditioner mounted on a wall body according to an embodiment of the present disclosure.

As illustrated in FIG. 28, the window air conditioner 3000 is adapted to be mounted at a window in a wall body C20 for cooling or heating an indoor environment.

Figure 29:
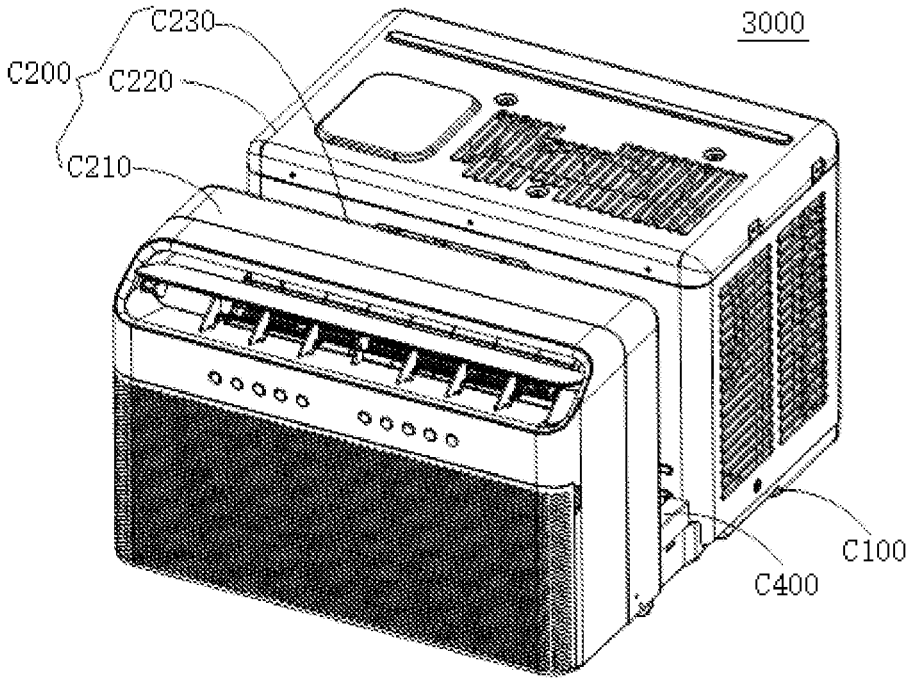
FIG. 29 is a schematic view of the window air conditioner illustrated in FIG. 28.
Figure 30:
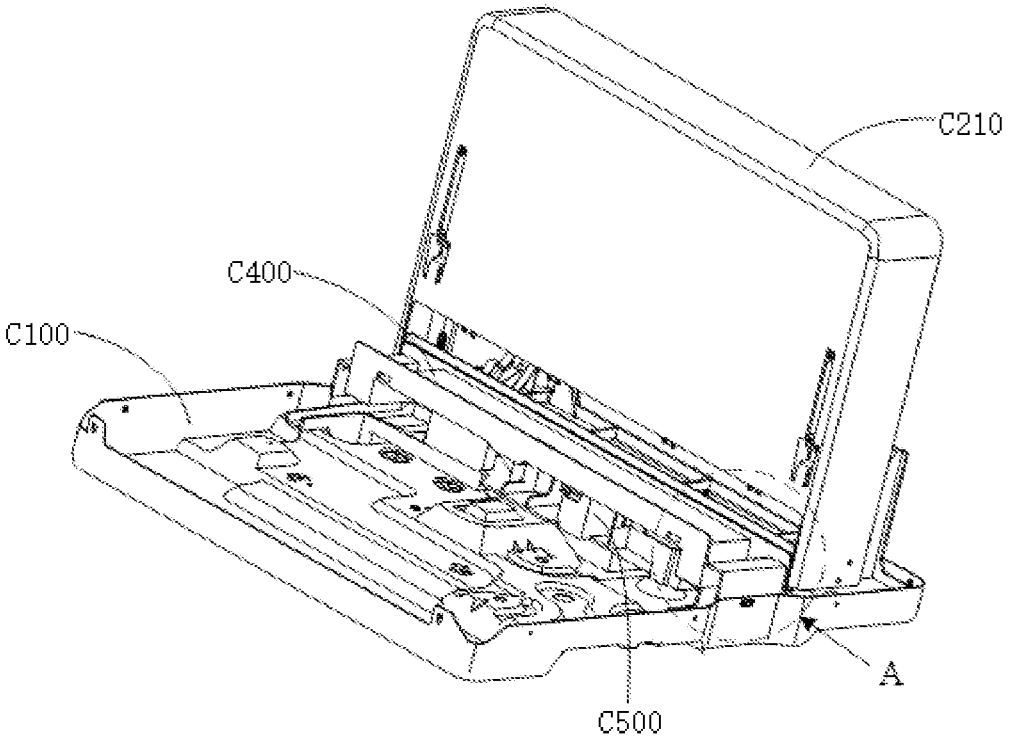
FIG. 30 is a schematic view showing a partial structure of the window air conditioner illustrated in FIG. 29.

As illustrated in FIG. 28 to FIG. 30, the window air conditioner 3000 includes a base C100, a casing body C200, a support member C500, and a middle partition plate C400. The casing body C200 has an accommodation groove C230 formed therein. The accommodation groove C230 divides the casing body C200 into a front housing C210 and a rear housing C220, and is adapted to allow a window sash C30 located at the window in the wall body C20 to extend therein. The support member C500 is arranged on the base C100 and corresponds to the accommodation groove C230. The middle partition plate C400 is mounted on the support member C500 and is adapted to allow the window sash C30 to abut therewith. Here, the middle partition plate C400 has a positioning member C440 formed on a bottom surface thereof, and the support member C500 has a socket C510 formed thereon. The socket C510 corresponds to the positioning member C440. The middle partition plate A400 is connected to the socket C510 of the support member C500 by inserting the positioning member C440 with the socket C510.

Figure 34:
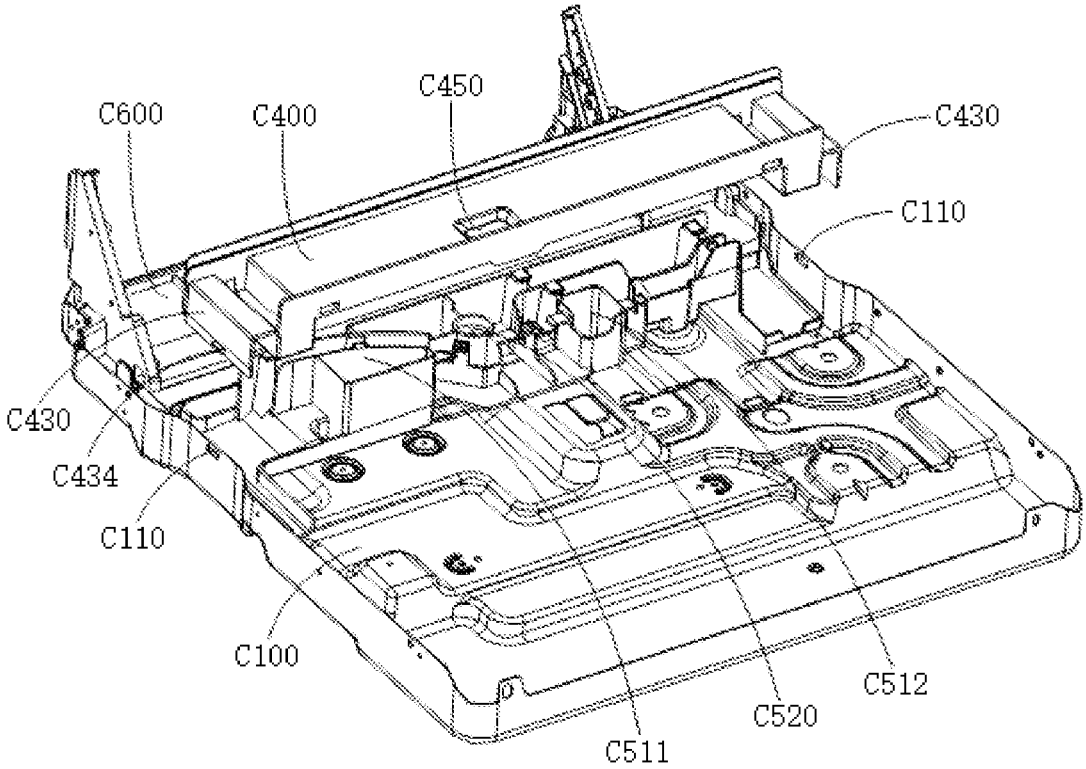
FIG. 34 is a schematic view showing an assembly of a middle partition plate and a base illustrated in FIG. 32.
Figure 35:
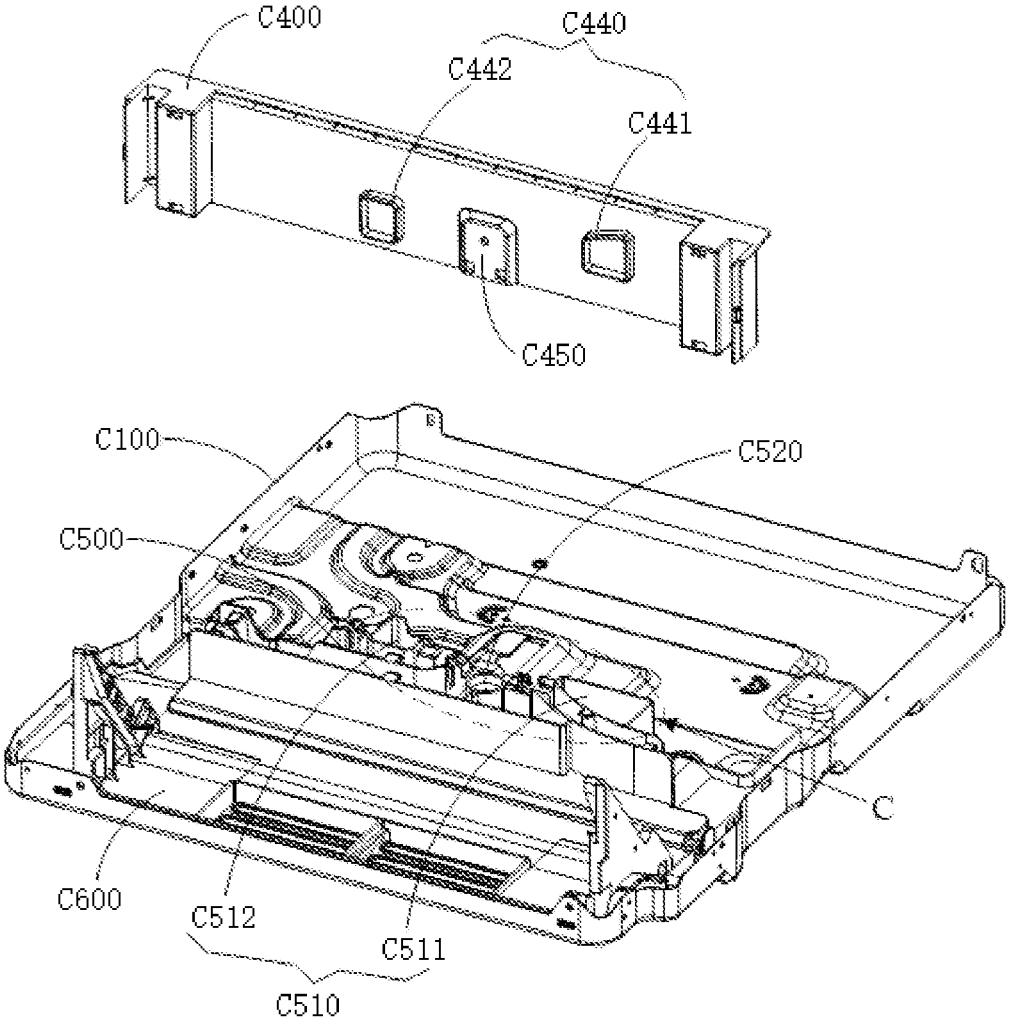
FIG. 35 is a schematic view showing a disassembly of a middle partition plate and a base illustrated in FIG. 33.

As illustrated in FIG. 34 and FIG. 35, during mounting the middle partition plate C400, since the support member C500 is formed with the socket C510 corresponding to the positioning member C440, the positioning member C440 of the middle partition plate C400 is aligned with the socket C510 on the support member C500 first, and then the middle partition plate C400 is pressed from the top to bottom to insert the positioning member C440 of the middle partition plate C400 into the socket C510 of the support member C500, thereby connecting and fixing the middle partition plate C400 to the support member C500. That is, the middle partition plate C400 is engaged with the support member C500 by inserting the positioning member C440 into the socket C510, and thus the middle partition plate C400 can be detached or mounted by pulling the positioning member C440 out of the socket C510 or pressing the positioning member C440 into the socket C510, which reduces the use of a screw structure or an engagement structure, thereby simplifying a mounting manner of the middle partition plate C400 and realizing quick mounting of the middle partition plate C400. In addition, since such an insertion connection method does not require a large mounting space, an interference with a side wall of the accommodation groove C230 during mounting can be reduced.

After the window air conditioner 3000 is mounted at the window in the wall body C20, the window sash C30 is pulled downwardly to extend into the accommodating groove C230 (as illustrated in FIG. 28) of the window air conditioner 3000 until a lower edge of the window sash C30 is brought into contact with and abuts with an upper surface of the middle partition plate C400. The window sash C30 blocks a gap between the both sides of the window air conditioner 3000 and side walls of the window to avoid a leakage of indoor cold or heated air from the gap to the outdoor space. It should be noted that the window sash C30 may also be replaced with a window louver, or a curtain or the like that blocks light, or other protective window plates that can block an external object from entering the indoor space.

In the above process of mounting the window air conditioner 3000, compared with a window sash in the related art that can only be pulled up to a top surface of the window air conditioner 3000, the window sash C30 according to this embodiment can be inserted into the window air conditioner 3000. In this way, it is possible for the window sash C30 to block a space between the both sides of the window air conditioner 3000 and a bottom wall of the window, thereby increasing an occupation area of the window sash C30.

In the technical solution of the present disclosure, the positioning member C440 is formed on the bottom surface of the middle partition plate C400, the support member C500 is formed on a bottom portion of the casing body C200, the support member C500 is formed with the socket C510 corresponding to the positioning member C440, and the middle partition plate C400 is inserted in and connected to the socket C510 of the support member C500 with the positioning member C440, such that the middle partition plate C400 can be connected and fixed to the support member C500. It can be seen that in the window air conditioner 3000 of the present disclosure, the middle partition plate C400 and the support member C500 is engaged with each other by inserting the positioning member C440 into the socket C510, which reduces the use of the screw structure or the engagement structure, thereby simplifying the mounting manner of the middle partition plate C400. Further, it is possible to lower a difficulty in mounting the middle partition plate C400, thereby realizing quick mounting of the middle partition plate C400 and further improving the mounting efficiency.

Figure 31:
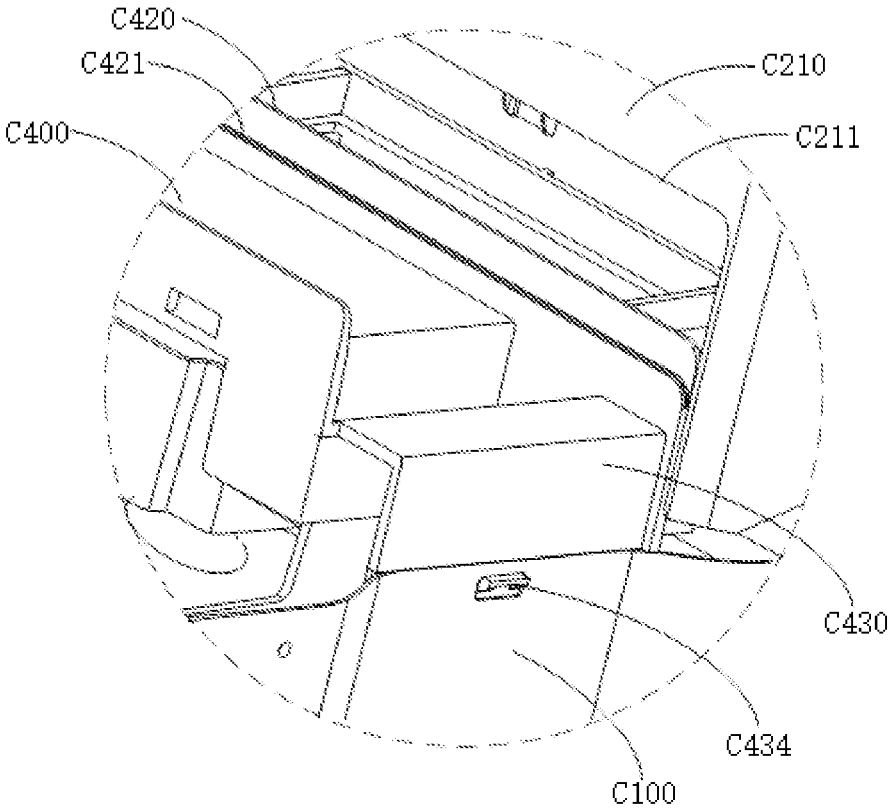
FIG. 31 is an enlarged view of part A illustrated in FIG. 30.

As illustrated in FIG. 31, in some embodiments, the window air conditioner 3000 further includes a water receiving tray C600 mounted on the base C100. The water receiving tray C600 corresponds to the front housing C210. On this basis, the support member C500 may be formed on the water receiving tray C600 to be arranged to the base C100 by the water receiving tray C600. Alternatively, the support member C500 may be formed directly on the base C100. The support member C500 may be a separately molded support part, or may be formed into one piece with the base C100, or formed into one piece with the water receiving tray C600.

Here, specifically, the support member C500 and the water receiving tray C600 are integrally formed to reduce fabrication procedures. The water receiving tray 600 has a rear end extending to a position below the middle partition plate C400 and has the support member C500 at a part thereof located below the middle partition plate C400. In this manner, the support member C500 can support the middle partition plate C400, and water on the middle partition plate C400 can be directly discharged downwardly into the water receiving tray C600.

As illustrated in FIG. 30 to FIG. 35, in some embodiments, the middle partition plate C400 includes a bottom plate C410 and end side plates C430 formed at both ends of the bottom plate C410. The positioning member C440 is formed on the bottom plate C410 of the middle partition plate C400. The number of the positioning members C440 on the middle partition plate C400 is not specifically limited herein. One positioning member C440 may be provided and formed at a middle position of the middle partition plate C400. Alternatively, a plurality of positioning members C440 may be provided and arranged at intervals in a length direction of the middle partition plate C400.

Specifically, a plurality of positioning members C440 are provided and arranged at intervals in a length direction of the middle partition plate C400. Correspondingly, a plurality of sockets 510 are provided. The plurality of positioning members C440 is inserted in and connected to the plurality of sockets C510 in one-to-one correspondence. By connecting and inserting the middle partition plate C400 to the plurality of sockets C510 of the support member C500 with the plurality of positioning members C440, a fixing effect of a connection between the middle partition plate C400 and the support member 500 can be enhanced, and thus loosening of the middle partition plate C400 is less likely to occur.

Figure 36:
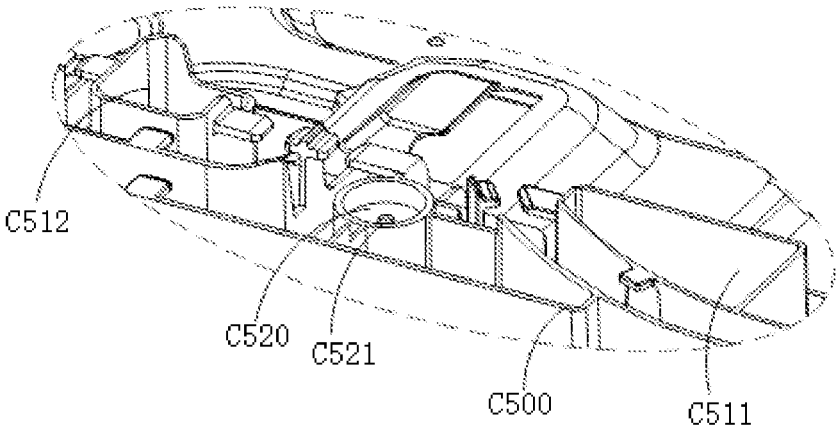
FIG. 36 is an enlarged view of part C illustrated in FIG. 35.
Figure 37:
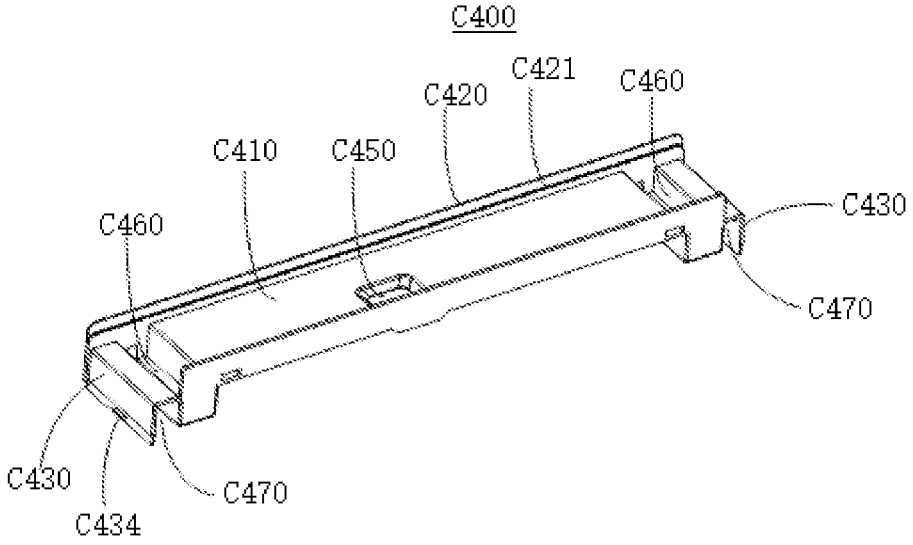
FIG. 37 is a schematic structural view of the middle partition plate illustrated in FIG. 34.

As illustrated in FIG. 35 to FIG. 37, further, the plurality of positioning members C440 includes a first positioning member C441 and a second positioning member C442 which are different from each other in shape. The plurality of sockets C510 includes a first socket C511 for an insertion of the first positioning member C411 and a second socket C512 for an insertion of the second positioning member C442.

Since the first positioning member C441 and the second positioning member C442 have different shapes, the middle partition plate C400 can be pressed and inserted into the support member C500 only when the first positioning member C441 corresponds to the first socket C511 and the second positioning member C442 corresponds to the second socket C512 during mounting the middle partition plate A400. However, if the first positioning member C441 corresponds to the second socket C512 or another socket C510, and the second positioning member C442 corresponds to the first socket C511 or another socket 510, it is difficult to press and insert the middle partition plate C400 into the support member C500, thereby alerting an installation personnel that the middle partition plate C400 should be reversed. After the middle partition plate C400 is reversed, the first positioning member C441 can correspond to the first socket C511 and the second positioning member 442 can correspond to the second socket C512, such that the middle partition plate A400 can be pressed and inserted into the support member 500 without visually calibrating whether each positioning member C440 corresponds to a corresponding one of the plurality of sockets C510 by an user, thereby achieving a blind insertion.

Figure 38:
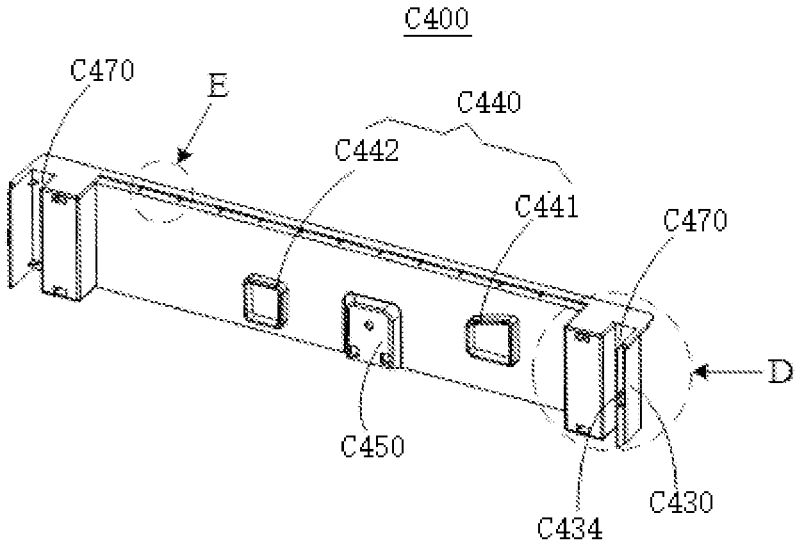
FIG. 38 is a schematic view of a middle partition plate illustrated in FIG. 37 viewed from another perspective.

As illustrated in FIG. 37 and FIG. 38, the shape of each of the first positioning member C441 and the second positioning member C442 is not specifically limited herein. For example, the first positioning member C441 may have a circle, an oval, or a polygon shape (such as a triangular, square, trapezoidal, pentagonal shape or the like.), or other irregular shapes. The second positioning member C442 only needs to be different from the first positioning member C441. Specifically, the first positioning member C441 has a trapezoidal shape, and the second positioning member C442 has a square shape. Correspondingly, an insertion chamber of the first socket C511 has the same shape as the first positioning member C441 for an insertion of the first positioning member C441, and an insertion chamber of the second socket C512 has the same shape as the second positioning member C442 for an insertion of the second positioning member C442.

As illustrated in FIG. 36 to FIG. 38, it is taken into consideration herein that during fabrication of the middle partition plate C400 and the support member C500, due to possible errors in dimensions of individual structures, a distance between the first positioning member C441 and the second positioning member C442 may be different from a distance between the first socket C511 and the second socket C512, which resulting in a difficulty in precisely aligning the middle partition plate C400 with the support member C500 easily.

In view of this, a volume of the insertion chamber of the first socket C511 is set to be greater than that of the insertion chamber of the first positioning member C441. During mounting the middle partition plate C400, when the first positioning member C441 is inserted into the insertion chamber of the first socket C511, a certain space may be left in the insertion chamber, and a position of the partition plate in a leftward-rightward direction thereof can be adjusted due to such a left space to align the second positioning member C442 with the second socket C512, such that the second positioning member C442 can be inserted into the second socket C512. In this way, a mounting resistance caused by the dimensional errors can be overcome, thereby effectively lowering a difficulty in calibration.

In some embodiments, the middle partition plate C400 has a bisecting line that bisects its length, and the first positioning member C441 and the second positioning member C442 are asymmetrical about the bisecting line. During mounting the middle partition plate, it should be that the first positioning member C441 is inserted into the first socket C511 and the second positioning member C442 is inserted into the second socket C512. If the middle partition plate is rotated by 180°, although the first positioning member C441 is close to the second socket C512, the first positioning member C441 is misaligned with the second socket C512, and similarly, the second positioning member C442 is misaligned with the first socket C511, and thus an alignment is impossible, thereby alerting the installation personnel to reverse the middle partition plate C400. In this manner, the middle partition plate C400 can be mounted in place without visually calibrating whether each positioning member C440 corresponds to a corresponding one of the plurality of sockets C510 by the user, thereby achieving the blind insertion.

As illustrated in FIG. 30, FIG. 31, and FIG. 38, in some embodiments, the middle partition plate C400 includes the bottom plate C410 and end side plates C430 formed at both ends of the bottom plate C410, and the bottom plate C410 is formed with the positioning member C440 on the bottom surface thereof to be inserted in and connected to the socket C510 of the support member C500. In addition, the two end side plates C430 are connected to opposite side walls of the base C100, respectively, to improve mounting stability of the middle partition plate C400.

Optionally, one of the side wall of the base C100 and the end side plates C430 of the middle partition plate C400 has a laterally protruding snap buckle C434 provided thereon, and the other of the side wall of the base C100 and the end side plates C430 of the middle partition plate C400 has an engagement hole C110 formed therein. The engagement hole C110 corresponds to the snap buckle C434 and is adapted to be engaged with the snap buckle C434. The mounting of the middle partition plate C400 will be described below by taking the snap buckle C434 being arranged on the end side plate C430 and the engagement hole C110 being arranged on the side wall of the base C100 as an example.

During mounting the middle partition plate C400, the end side plates C430 at both ends of the middle partition plate C400 are pressed inwardly in such a manner that each end side plate C430 of the middle partition plate C400 extends into an inner side of the side wall of the base C100 corresponding to the end side plate C430. Then, the positioning member C440 of the middle partition plate A400 is inserted into the socket C510 of the support member C500 from top to bottom. In this process, each of the end side plates C430 at both ends of the middle partition plate A400 is compressed inwardly against the side wall of the base C100 until the snap buckle C434 on the end side plate C430 is brought into contact with the engagement hole C110 on the side wall of the base C100 in response to the positioning member C440 of the middle partition plate C400 being inserted into the socket C510 of the support member C500 in place. In this case, a compress force of the side wall of the base C100 against the end side plate C430 is removed, and the end side plate C430 is elastically biased back to its original position to urge the snap buckle C434 into the engagement hole C110 in the side wall of the base C100, thereby connecting the end side plate C430 to the side wall of the base C100.

Figure 39:
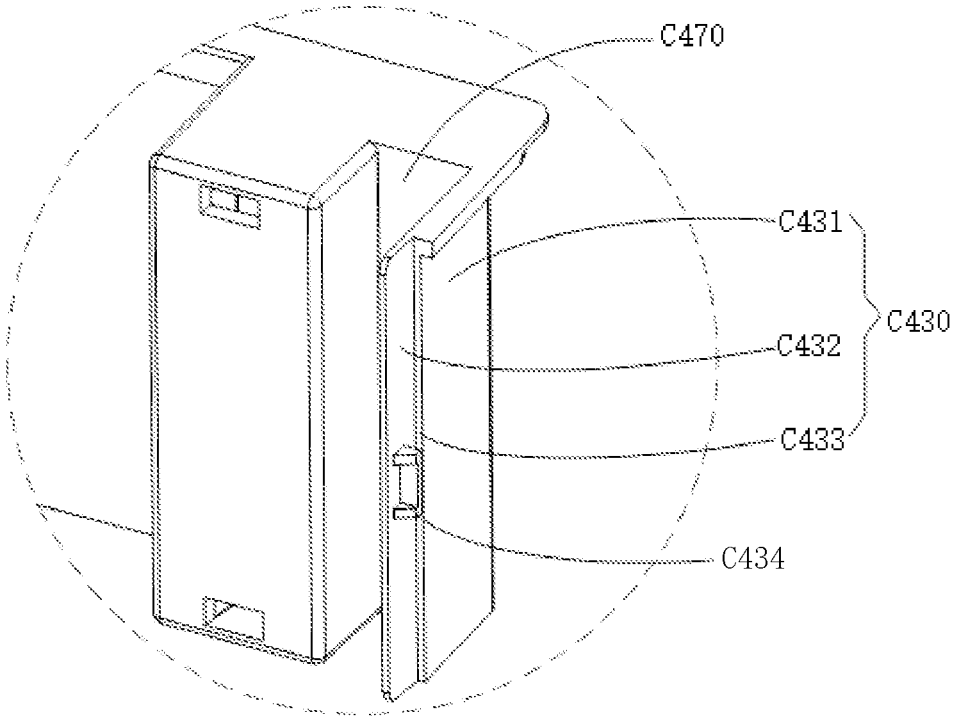
FIG. 39 is an enlarged view of D illustrated in FIG. 38.

As illustrated in FIG. 38 and FIG. 39, optionally, each of the end side plates C430 includes a first plate body C431 connected to the bottom plate C410 and a second plate body C432 connected to the first plate body C431. Here, the second plate body C432 is formed with the snap buckle C434, and the second plate body C432 and the first plate body C431 are connected to each other at a connection platform C433. When the snap buckle C434 is engaged with the engagement hole C110, the connection platform C433 abuts with an upper edge of the side wall of the base C100 (as illustrated in FIG. 30 and FIG. 31). In this manner, an end portion of the middle partition plate C400 can be supported by the side wall of the base C100, and the support member C500 is supported between both end portions of the middle partition plate A400, thereby improving the mounting stability of the middle partition plate C400.

As illustrated in FIG. 30, FIG. 31, and FIG. 37, in some embodiments, the middle partition plate C400 further includes side plates C420 formed at opposite sides of the bottom plate C410. The two side plates C420 are attached to a back plate of the front housing C210 and a back plate of the rear housing C220, respectively. It is taken into consideration herein that, due to a possible gap between the side plate C420 and the back plate of the front housing C210, enteral water may fall into an interior of the front housing C210 through the gap.

In view of this, to avoid such a situation, one of the side plates C420 has a support platform C421 formed on an inner surface thereof, and the support platform C421 extends in a length direction of the side plate. The front housing C210 has a notch C211 formed at the back plate thereof, and the notch C211 corresponds to the support platform C421 and abuts with the support platform C421 at an upper edge thereof. That is, the back plate of the front housing C210 rests on the support platform C421 of the side plate C420 of the middle partition plate C400 to reduce the gap between the back plate of the front housing C210 and the side plate C420 of the middle partition plate C400. The external water is guided by the back plate of the front housing C210 to flow towards the side plates C420 of the middle partition plate C400, and then flows into an interior of the middle partition plate C400 from the side plate C420.

Figure 40:
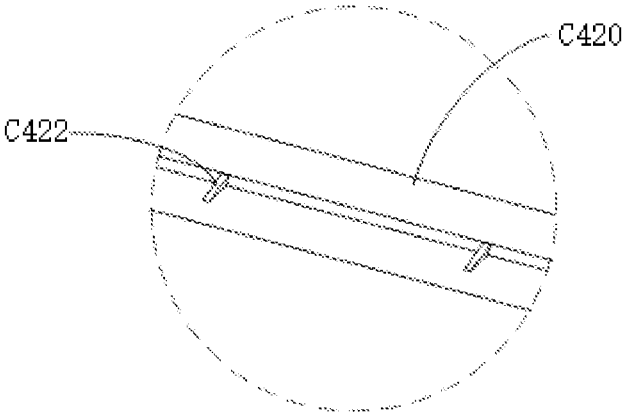
FIG. 40 is an enlarged view of E illustrated in FIG. 38.

As illustrated in FIG. 38 and FIG. 40, since the back plate of the front housing C210 rests on the support platform C421 of the side plate C420 of the middle partition plate C400, a part of a weight of the front housing C210 is applied to the side plate C420 of the middle partition plate C400. To this end, the side plate C420 has a plurality of reinforcing ribs C422 formed at a position on an outer surface thereof corresponding to the support platform C421. The plurality of reinforcing ribs C422 is arranged at intervals in an extension direction of the support platform C421. A strength of the side plate C420 of the middle partition plate C400 can strengthened by the plurality of reinforcing ribs C422 to prevent the side plate C420 from being bent and deformed by the back plate of the front housing C210.

As illustrated in FIG. 32, FIG. 33, and FIG. 35 to FIG. 37, based on any one of the above embodiments, the middle partition plate C400 further has a fixation part C450 formed at a middle portion thereof, the support member C500 has an engagement member C520 formed thereon. The engagement member C520 corresponds to the fixation part C450, and the fixation part C450 is connected and fixed to the engagement member C520 by a connection member. After the middle partition plate C400 is inserted in and connected to the support member C500, the fixation part C450 of the middle partition plate C400 and the engagement member C520 of the support member C500 are connected to each other by the connection member to further secure the middle partition plate C400.

Specifically, the bottom plate C410 of the middle partition plate A400 is recessed downwardly in a middle portion thereof to form a recess. The recess is formed with the fixation part C450 at a bottom portion thereof. The fixation part C450 has a fixation hole formed therein. The engagement member C520 has an engagement hole C521 formed therein. The engagement hole C521 corresponds to the fixation hole, and is adapted to be connected to the fixation hole on the fixation part C450 by the connection member. The connection member may be a screw or a pin.

Figure 32:
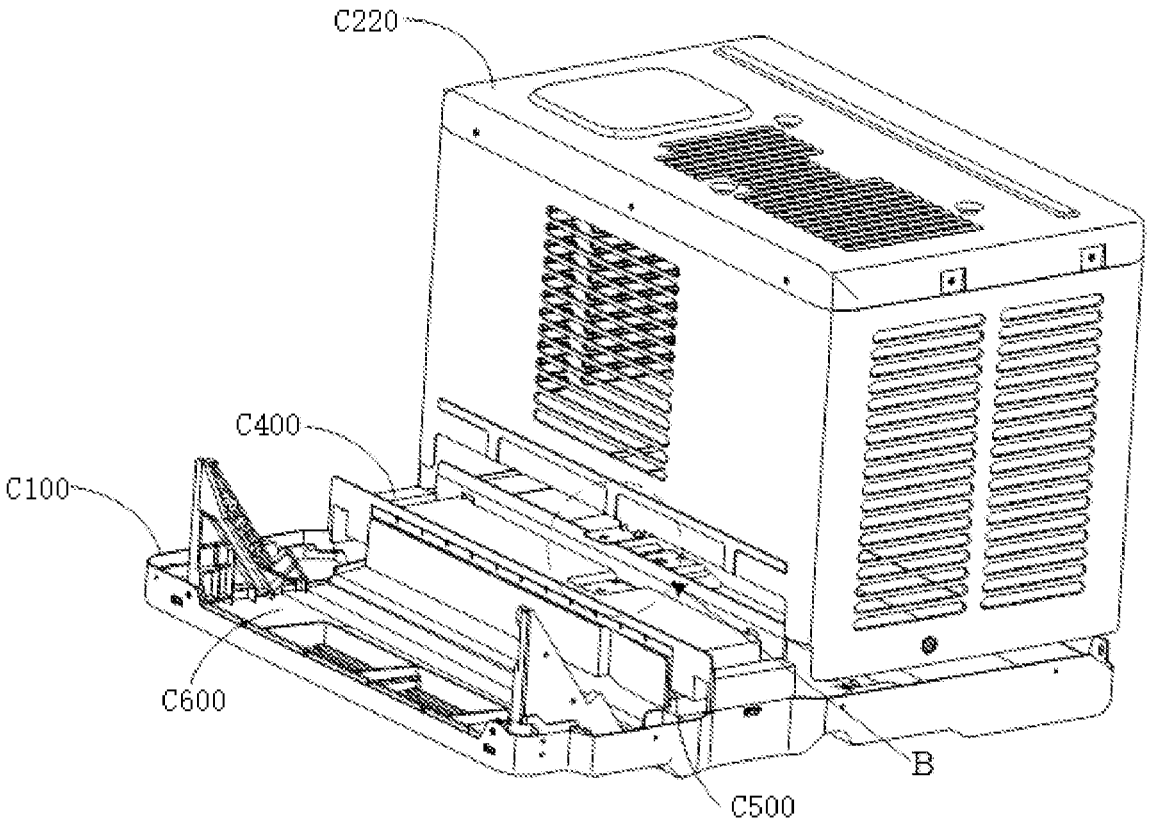
FIG. 32 is a schematic view showing another partial structure of the window air conditioner illustrated in FIG. 28.
Figure 33:
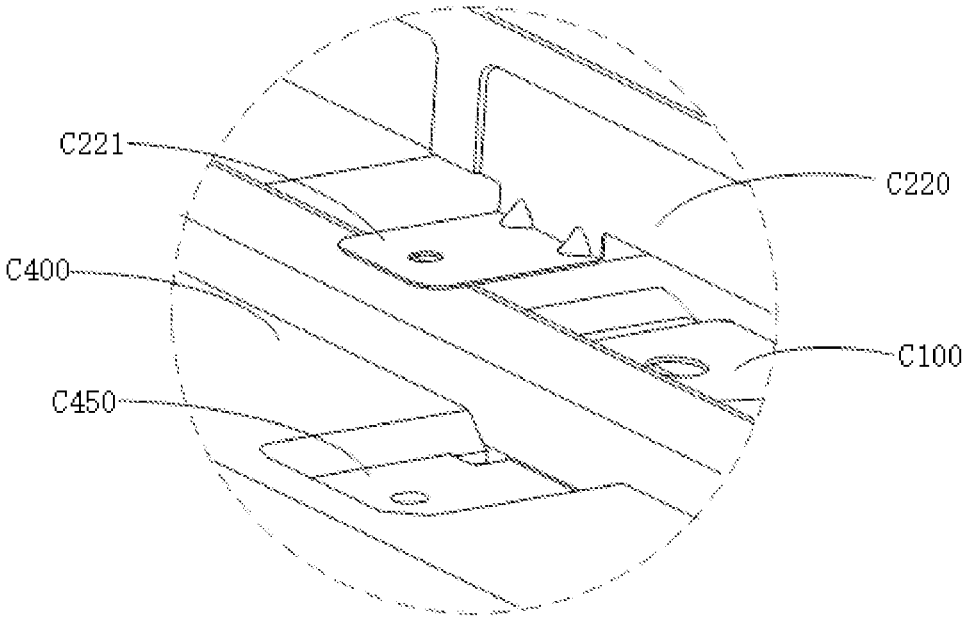
FIG. 33 is an enlarged view of part B illustrated in FIG. 32.

With continued reference to FIG. 32, FIG. 33, and FIG. 37, further, the casing has a fixation plate C1211 extending therefrom towards the fixation part C450, and thus the casing body C200 has the fixation plate C1211 extending therefrom towards the fixation part C450. The connection member passes through the fixation plate C1221, the fixation part C450 and the engagement member C520 in sequence to integrally connect and fix the middle partition plate C400 to the casing body C200 and the support member C500, thereby strengthening a fixing strength of the middle partition plate C400, such that the middle partition plate C400 is less liable to loosening.

Specifically, a housing C120 of the casing body C200 is divided into the front housing C210 and the rear housing C220 by the accommodation groove C230, and the back plate of the front housing C210 and the back plate of the rear housing C220 is form as two side walls of the accommodation groove C230, respectively. Therefore, the fixation plate C1221 can be formed on the back plate of the front housing C210 or on the back plate of the rear housing C220. Here, specifically, the fixation plate C1221 is formed on the back plate of the rear housing C220.

Figure 41:
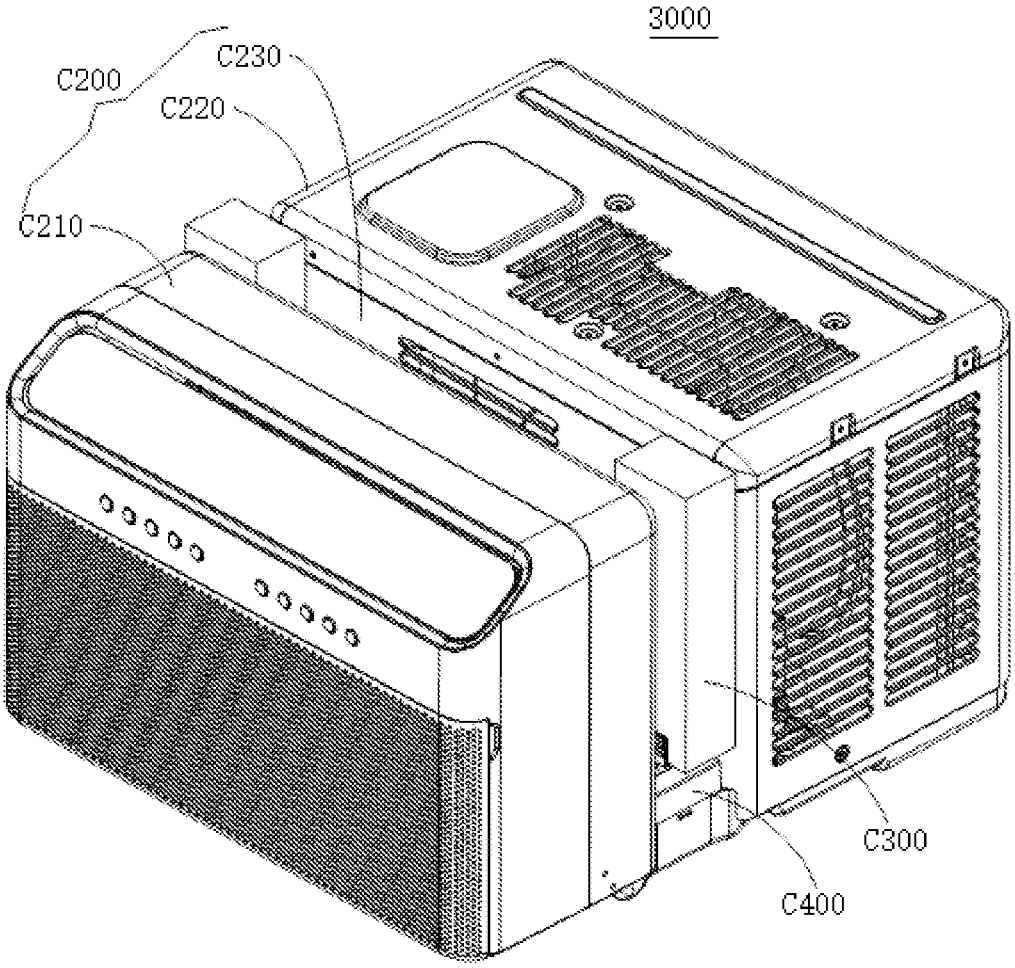
FIG. 41 is a schematic structural view of a window air conditioner according to yet another embodiment of the present disclosure, in which a sealing assembly is in a storage state.

As illustrated in FIG. 41, based on any one of the above embodiments, the window air conditioner 3000 further includes a compressor, an outdoor heat exchanger, an outdoor fan, an indoor heat exchanger, and an indoor fan. Here, the compressor, the outdoor heat exchanger, and the outdoor fan are mounted within the rear housing C220, and the indoor heat exchanger and the indoor fan are mounted within the front housing C210, such that noises generated by members at an outdoor side can be prevented from propagating to an indoor side, thereby achieving noise reduction effect.

Figure 42:
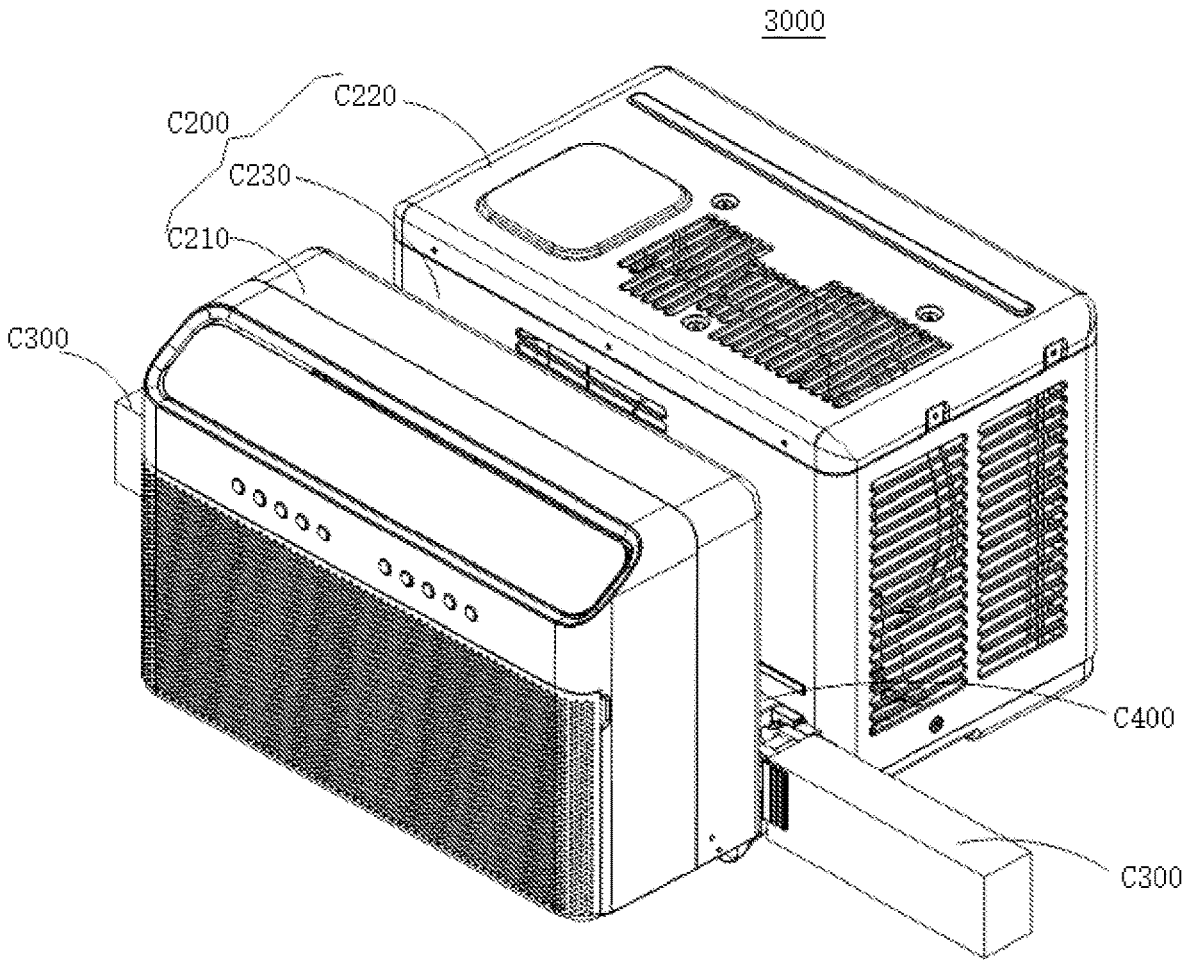
FIG. 42 is a schematic view of a window air conditioner illustrated in FIG. 41 with the sealing assembly switched to an operation state.

As illustrated in FIG. 41 and FIG. 42, in some embodiments, the window air conditioner 3000 further includes a sealing assembly C300. The sealing assembly C300 is movably mounted on the middle partition plate C400, and is switchable between a storage state and an operation state through movement. Here, in the storage state, the sealing assembly C300 is received in the accommodation groove C230, and in the operation state, the sealing assembly C300 extends laterally from the accommodation groove C230 and is adapted to be abutted against the window sash C30 and/or an inner wall of the window.

After the window air conditioner 3000 is mounted at the window, the sealing assembly C300 is moved to the operation state in such a manner that the sealing assembly 300 extends laterally from the accommodation groove C230 of the window air conditioner 3000 with a bottom surface of the sealing assembly C300 abutted against the bottom wall of the window. Then, the window sash C30 is pulled downwardly to extend into the accommodation groove C230 of the window air conditioner 3000 until the lower edge of the window sash C30 is brought into contact and abuts with the middle partition plate C400 and the sealing assembly C300. The sealing assembly C300 is filled in a gap between the window sash C30 and the bottom wall of the window and seals the gap to reduce an amount of cold or heated air that leaks from the indoor space to the outdoor space through the gap. When the window air conditioner 3000 is not needed or is transported, the sealing assembly C300 is moved to the storage state to reduce a space occupied by the sealing assembly C300, thereby facilitating storage or packaging of the window air conditioner 3000.

Movable mounting for the sealing assembly C300 may be implemented in various ways. For example, the sealing assembly C300 may be slidably mounted on the middle partition plate C400. Alternatively, the sealing assembly C300 may be rotatably mounted on the middle partition plate C400. Additionally, alternatively, the sealing assembly C300 may be mounted on the middle partition plate C400 in a resiliently retractable manner. Specifically, the sealing assembly C300 is rotatably connected to the middle partition plate C400 to allow the sealing assembly C300 to be switchable between the operation state and the storage state through a rotation.

As illustrated in FIG. 34, FIG. 37, and FIG. 41, further, the middle partition plate C400 further has a placement space C460 formed therein for mounting the sealing assembly C300. A side wall of the placement space C460 is spaced apart from the end side plate C430 of the middle partition plate C400 to form a clearance groove C470 between the side wall of the placement space C460 and the end side plate C430. The clearance groove C470 can provide greater elasticity to the end side plate C430. The end side plate C430 can be elastically biased towards an inner side of the clearance groove C470, thereby allow the end side plate C430 to be biased towards the inner side of the clearance groove C470 by compression of the side wall of the base C100 during mounting the middle partition plate C400, until the snap buckle C434 on the end side plate C430 is brought into contact with the engagement hole on the side wall of the base C100. When the snap buckle C434 on the end side plate C430 is in contact with the engagement hole on the side wall of the base C100, the end side plate C430 is elastically biased back to its original position to urge the snap buckle C434 into the engagement hole, thereby connecting and fixing the end side plate C430 to the side wall of the base C100.

In the description of this specification, descriptions with reference to the terms "an embodiment," "some embodiments," "illustrative embodiments," "an example," "a specific example," "some examples," etc., are intended to mean that specific features, structure, materials, or characteristics described in conjunction with the embodiment or example are included in at least one embodiment or example of the present disclosure. In this specification, the schematic representations of the above terms do not necessarily refer to the same embodiment or example. Moreover, the described specific features, structures, materials or characteristics may be combined in any one or more embodiments or examples in a suitable manner.

Although embodiments of the present disclosure have been illustrated and described, it should be understood for those skilled in the art that various changes, modifications, replacements, and variations can be made to these embodiments without departing from the principles and spirit of the present disclosure. The scope of the invention shall be defined by the claims as appended and their equivalents.

What is claimed is:

1. A sealing assembly comprising:

a first member configured to be connected to a casing of a window air conditioner to be supported at a window, the casing having an accommodation groove, and the first member including a pivoting shaft;

a sealing member connected to the first member and configured to be sealingly arranged between:

a window sash of the window that is at least partially extended in the accommodation groove, and an inner wall of the window; and a second member configured to be fixed at the casing, the first member being rotatably disposed on the second member to enable the sealing assembly to rotate to be received in the accommodation groove, and the second member including a pivoting hole configured to be rotatably engaged with the pivoting shaft of the first member.

2. The sealing assembly according to claim 1, wherein the first member has a mounting groove, a part of the sealing member being mounted in the mounting groove.

3. The sealing assembly according to claim 2, wherein the mounting groove includes a locking ridge provided on each of two opposite side surfaces of the mounting groove and configured to be in contact with the sealing member to position the sealing member within the mounting groove.

4. The sealing assembly according to claim 1, wherein the second member includes a rib provided on each of two opposite side walls of the second member and configured to be in contact with an inner wall surface of the accommodation groove at a corresponding side.

5. The sealing assembly according to claim 4, wherein the rib includes a guide chamfer provided at a lower end of the rib.

6. The sealing assembly according to claim 4, wherein the second member further includes a sealing plate provided on each of the two opposite side walls of the second member, the sealing plate extending towards the inner wall surface of the accommodation groove at the corresponding side and being located above the rib on the corresponding side.

7. The sealing assembly according to claim 1, further comprising:

an angle positioning assembly configured to cooperate with the second member and the first member to position the first member at a predetermined angle when the first member rotates to the predetermined angle.

8. A window air conditioner comprising:

a casing having an accommodation groove configured to receive at least a part of a window sash of a window; and a sealing assembly configured to be sealingly arranged between the window sash and an inner wall of the window, and including:

a first member configured to be connected to the casing and including a pivoting shaft;

a sealing member connected to the first member and configured to be sealingly arranged between:

the window sash that is at least partially extended in the accommodation groove, and the inner wall of the window; and a second member configured to be fixed at the casing, the first member being rotatably disposed on the second member to enable the sealing assembly to rotate to be received in the accommodation groove, and the second member including a pivoting hole configured to be rotatably engaged with the pivoting shaft of the first member.

9. The window air conditioner according to claim 8, wherein the casing includes:

a base;

a rear housing fixed at the base and configured to accommodate an outdoor heat exchanger;

a front housing fixed at the base and arranged to be spaced apart from the rear housing to form the accommodation groove; and a middle partition plate fixed at the base and located within the accommodation groove, a front end and a rear end of the middle partition plate being engaged with the rear housing and the front housing, respectively.

10. The window air conditioner according to claim 9, further comprising:

a water receiving tray mounted on the base and including drainage groove configured to drain water to the base; wherein:

the middle partition plate includes a bottom plate and side plates formed at two opposite sides of the bottom plate, a receiving groove being formed by the side plates and the bottom plate;

the receiving groove is recessed downwardly at each of two ends of the receiving groove to form a placement space;

a first drainage hole is formed at one end of the placement space, the first drainage hole being located above the drainage groove of the water receiving tray and configured to drain water to the water receiving tray; and a second drainage hole is formed at another end of the placement space and is configured to drain water to the base directly.

11. The window air conditioner according to claim 10, wherein the water receiving tray partially extends to a position below the middle partition plate and includes a support member located below the middle partition plate, the support member supporting the middle partition plate.

12. The window air conditioner according to claim 10, wherein a water overflowing hole is formed in one side plate of the side plates that is closest to the rear housing among the side plates, the water overflowing hole penetrating the one side plate and being configured to drain water to a part of the base corresponding to an outdoor side.

13. The window air conditioner according to claim 9, wherein:

the base includes a support member, the support member including a socket; and the middle partition plate includes a positioning member provided on a bottom surface of the middle partition plate, the positioning member being configured to be inserted in the socket.

14. The window air conditioner according to claim 13, wherein:

the positioning member is one of a plurality of positioning members provided at the bottom surface of the middle partition plate, the plurality of positioning members being arranged at intervals in a length direction of the middle partition plate and including a first positioning member and a second positioning member having different shapes; and the socket is one of a plurality of sockets of the support member, the plurality of sockets including a first socket configured to receive the first positioning member and a second socket configured to receive the second positioning member.

15. The window air conditioner according to claim 13, wherein:

the middle partition plate includes a bottom plate and end side plates formed at two ends of the bottom plate;

the positioning member is formed at a bottom surface of the bottom plate; and the end side plates are connected to two opposite side walls of the base, respectively.

16. The window air conditioner according to claim 15, wherein each of the end side plates includes a first plate body connected to the bottom plate and a second plate body connected to the first plate body, a connection platform being formed at a location where the second plate body and the first plate body are connected to each other, and the connection platform abutting against an upper edge of the corresponding side wall of the base.

17. The window air conditioner according to claim 15, wherein:

the middle partition plate further includes side plates formed at two opposite sides of the bottom plate, a support platform being formed at an inner surface of one side plate of the side plates and extending in a length direction of the one side plate; and a notch is formed at a back plate of the front housing, an upper edge of the notch abutting against the support platform.

* * * * *